United States Patent [19]

Moon

[11] Patent Number: 4,548,132

[45] Date of Patent: Oct. 22, 1985

[54] REFUSE COMPACTOR

[76] Inventor: Jerry W. Moon, 1450 Kempster Rd., Lake Orion, Mich. 48035

[21] Appl. No.: 507,171

[22] Filed: Jun. 23, 1983

Related U.S. Application Data

[63] Continuation-in-part of Ser. No. 276,479, Jun. 23, 1981, abandoned.

[51] Int. Cl.[4] ..... B30B 15/14; B30B 15/06

[52] U.S. Cl. ..... 100/52; 100/229 A; 100/287; 100/295

[58] Field of Search ..... 141/73, 80; 312/339, 312/340, 341 R; 100/52, 53, 73, 229 A, 229 R, 255, 256, 287, 295

[56] References Cited

U.S. PATENT DOCUMENTS

| | | | |
|---|---|---|---|
| 131,805 | 10/1872 | Yarrell | 100/295 X |
| 1,998,517 | 4/1935 | Moore | 312/341 R |
| 3,353,478 | 11/1967 | Hopkins | 100/229 A |
| 3,714,890 | 2/1973 | Moon | 100/229 A |
| 3,717,091 | 2/1973 | Moon | 100/53 |
| 3,722,404 | 3/1973 | Moon | 100/52 |
| 3,732,805 | 5/1973 | Moon | 100/226 |
| 3,821,927 | 7/1974 | Stratman | 100/73 |
| 3,893,387 | 7/1975 | Eckerle | 100/229 A |
| 4,018,148 | 4/1977 | Wolbrink | 100/53 |
| 4,024,806 | 5/1977 | Weeks | 100/229 A |
| 4,047,775 | 9/1977 | Wolbrink | 312/211 |
| 4,064,798 | 12/1977 | Wolbrink et al. | 100/229 A |
| 4,100,850 | 7/1978 | Wolbrink et al. | 100/229 A X |
| 4,325,299 | 4/1982 | Farber | 100/229 A |

*Primary Examiner*—Billy J. Wilhite
*Attorney, Agent, or Firm*—Barnes Kisselle Raisch Choate Whittemore & Hulbert

[57] ABSTRACT

A refuse compactor of the type having a receptacle drawer removably contained within a cabinet wherein refuse is compacted by a ram to a fraction of its normal volume. The ram includes a refuse-compressing platen actuated through a toggle linkage to which force is applied by a single screw driven by an electric motor coupled to the screw through a reduction drive. The screw, motor and drive train are carried as a unit by the toggle linkage and move bodily therewith. Improvements are provided in the cabinet, receptacle drawer, compacting mechanism and mounting framework for the same which embody many structural and operational simplification features greatly reducing the size, weight and cost of the compactor. These features include mounting of the motor in the space between the screw and platen, a simplified toggle linkage mounting frame removably connected by brackets directly to the cabinet side walls, a one piece hinged door for the receptacle with integral alignment tabs, a contoured drawer rear wall cooperating with the platen to interlock the drawer in compacting position, a single sheet cabinet bottom wall and a tri-roller drawer supporting arrangement. Numerous other cost reduction and simplification features are also disclosed, including improvements in the platen assembly and gear box assembly.

51 Claims, 21 Drawing Figures

Fig-1
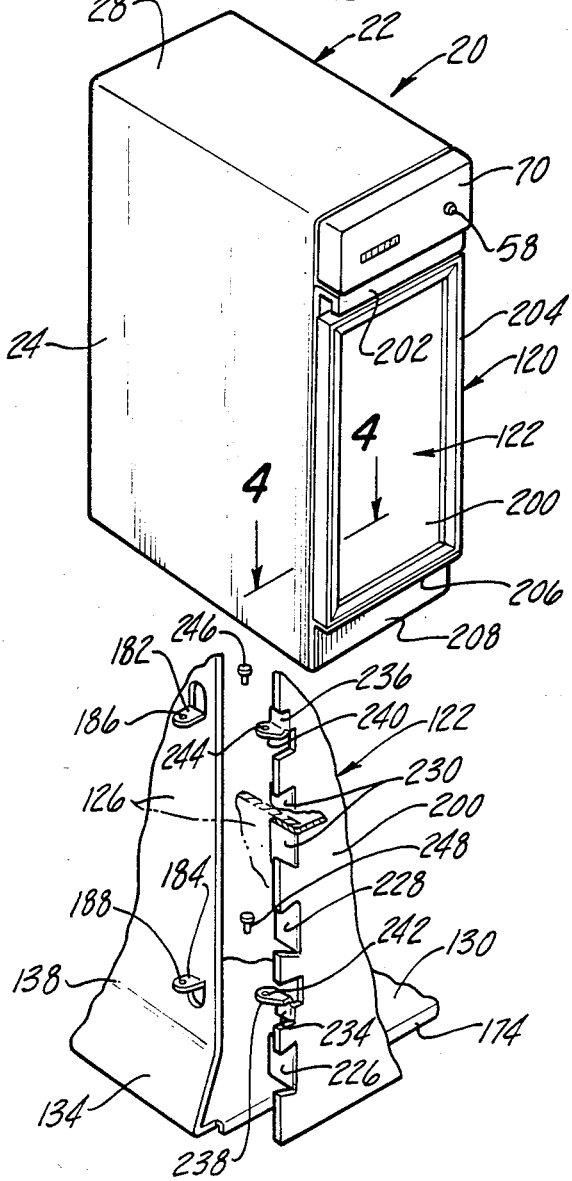
Fig-2
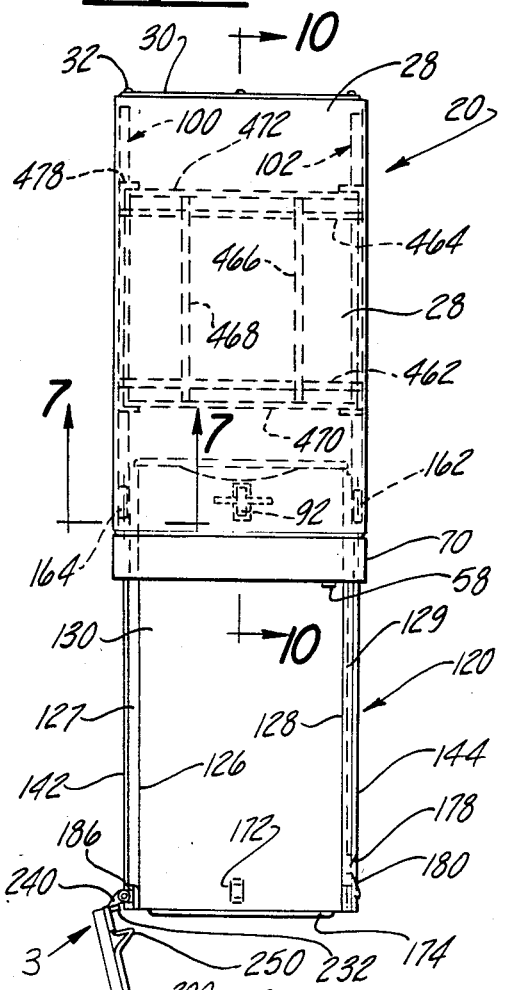
Fig-3
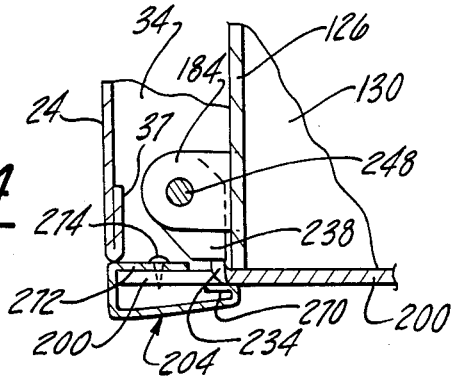
Fig-4
Fig-5

REFUSE COMPACTOR

This application is a continuation-in-part of my prior co-pending application Ser. No. 06/276,479 filed June 23, 1981, now abandoned and entitled REFUSE COMPACTOR, the benefit of the filing date of which is hereby claimed under 37 USC Sec. 120.

This invention relates to an apparatus for crushing, breaking, smashing and/or compacting all types of material and, more particularly, to a domestic refuse compactor which may be installed in a kitchen cabinet structure or provided as a free-standing domestic or commercial appliance.

In recent years, ways have been sought to improve methods and means for household refuse collection and disposal. As a result of this interest a relatively new major appliance for the home, the refuse compactor, has been commercially introduced. In my prior U.S. Pat. No. 3,714,890, and in my divisional U.S. Pat. Nos. 3,717,091, 3,722,404 and 3,732,805, a solid waste compactor is presented embodying improvements in the compacting mechanism, cabinetry, circuitry and other features which offers many advantages over prior refuse compactors. One embodiment of the refuse compactor of my aforementioned patents, which incorporates further improvements set forth in Wolbrink U.S. Pat. Nos. 4,018,148 and 4,047,775, and Wolbrink et al U.S. Pat. Nos. 4,064,798 and 4,100,850, has been and is successfully commercialized and sold under the trademark "signature" by Montgomery Ward as trash compactor models SBW-5010A, 5011A and 5012A, as disclosed in Montgomery Ward Service Manual No. 68341930.

The present invention comprehends, in general, the adoption of the compacting apparatus of the type disclosed in the aforementioned patents and commercial "Signature" trash compactor and thus embodies the objects and many of the features and advantages set forth in my aforementioned U.S. patents, which are thus incorporated herein by reference. However, it is also an object of the present invention to provide a new and improved refuse compactor which also enables a significant improvement to be obtained over the aforementioned patented and commercial trash compactors in terms of reductions in weight, size and cost without sacrifice of the trash compacting capacity and performance of such prior compactors.

Other objects, features and advantages of the present invention will become apparent from the following detailed description taken in conjunction with the accompanying drawings wherein:

FIG. 1 is a perspective view of a refuse or trash compactor constructed in accordance with the present invention as viewed from the exterior with the trash receptacle drawer in closed operative position.

FIG. 2 is a plan view of the refuse compactor of FIG. 1 with the drawer pulled out to the trash-loading position thereof, and with the front door of the drawer shown in open position.

FIG. 3 is an enlarged fragmentary perspective view of the portion of the drawer and door in the area indicated by the arrow labeled "3" in FIG. 2.

FIG. 4 is a fragmentary sectional enlarged view taken on the line 4—4 of FIG. 1 illustrating a portion of the drawer basket, door hinge, door trim and associated cabinet side wall.

FIG. 5 is a fragmentary elevational enlarged view of the portion of the drawer-door assembly shown in FIG. 4.

The accompanying drawings are generally drawn to scale except that the thickness of the sheet metal parts is exaggerated as required for better visability in the various views.

Referring in more detail to FIG. 1, an exemplary but preferred embodiment of the improved refuse compactor 20 of the present invention is illustrated in its normal closed and operative condition with the door of the drawer within the cabinetry of compactor 20.

COMPACTOR CABINETRY CONSTRUCTION

Figure 8:
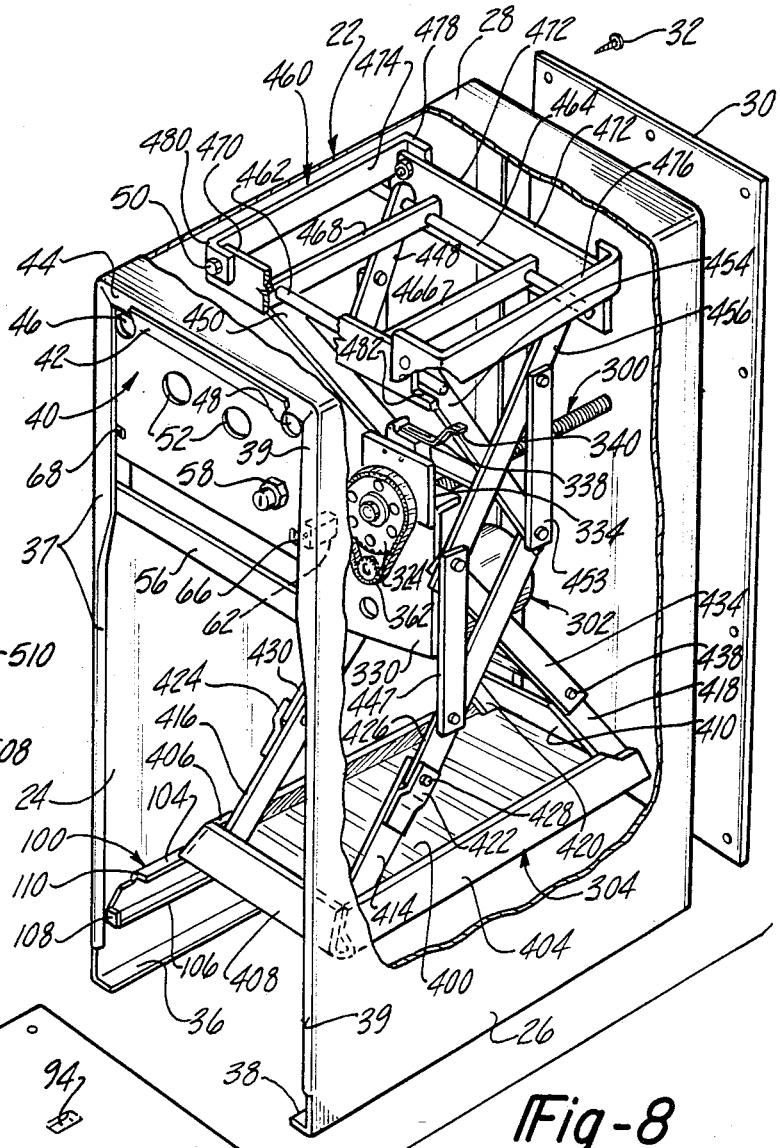
FIG. 8 is an exploded perspective view with portions cut away illustrating the cabinet structure and compacting mechanism of the refuse compactor of FIG. 1.
Figure 10:
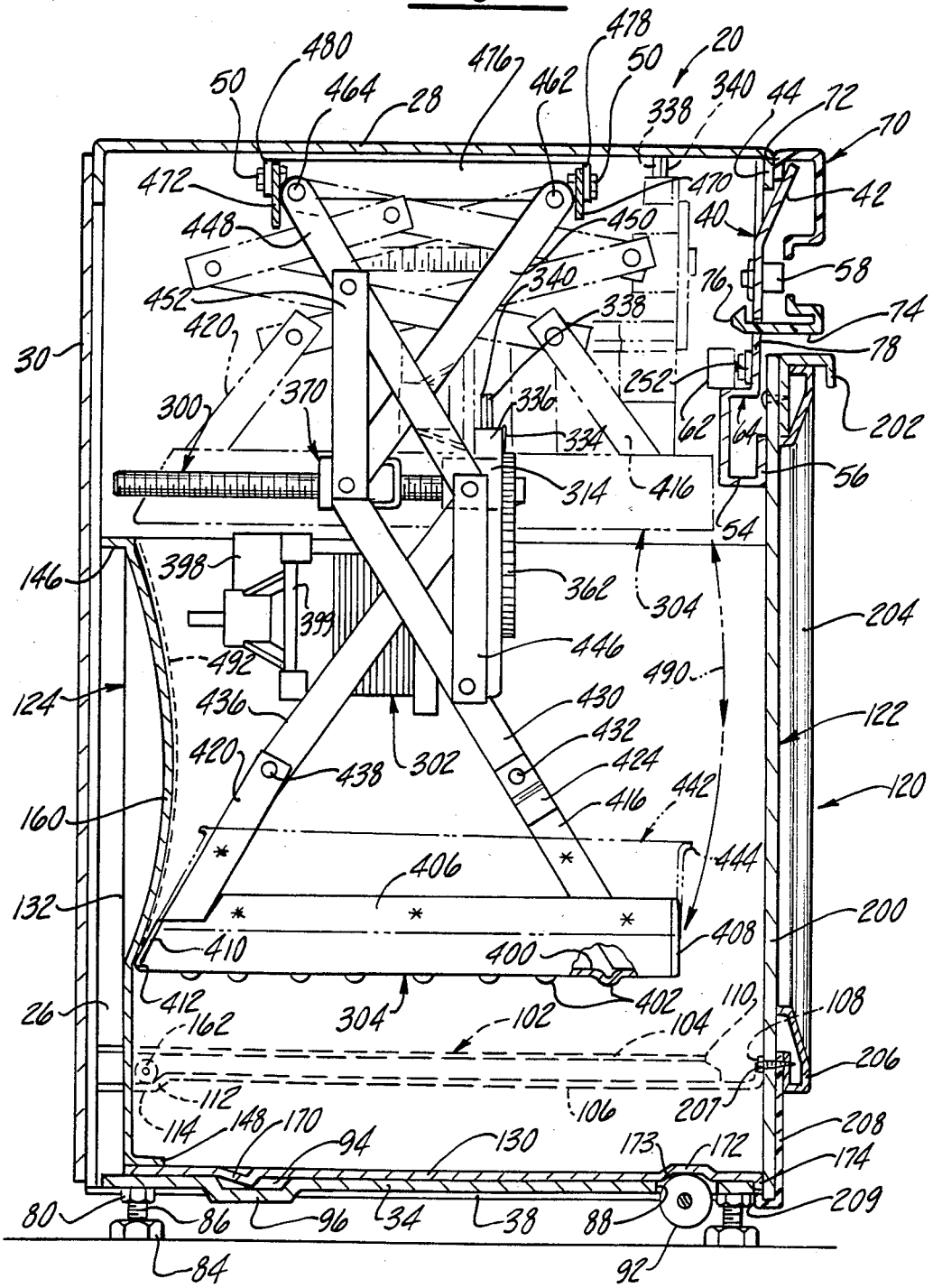
FIG. 10 is a vertical cross sectional view taken on the line 10—10 of FIG. 2 but illustrating the receptacle drawer and door in closed operating position.

Refuse compactor 20 comprises a rectangular sheet metal cabinet 22 having a pair of parallel upright side walls 24 and 26 (see also FIG. 8) integrally joined to a horizontal top wall 28. Cabinet 22 also includes a removable upright rear wall of panel 30 (FIGS. 2, 8 and 10) which is removably attached by sheet metal screws 32 to rear edge flanges of the top and side walls. The cabinet also includes a flat bottom wall 34 of relatively heavy gauge steel (for example, approximately ¼" in thickness compared to the sheet steel top and side wall gauge of approximately 0.043") which is supported, and affixed by spot welds to, the horizontal bottom edge flanges 36 and 38 of side walls 24 and 26 respectively. Bottom wall 34 is shown removed from the cabinet in FIG. 8 and in assembled relation in FIG. 10. At the front of the cabinet each of the side walls 24 and 26 has a vertically extending flange 37 and 39 respectively which, in the upper portion thereof, is bent at right angles to the associated side wall. A cabinet front panel 40 is affixed by spot welds to the inner faces of flanges 36 and 38, as best seen in FIGS. 8 and 10. Flanges 37 and 39, in the portions extending downwardly below panel 40, are bent back upon themselves, as best seen in FIGS. 4 and 8.

Front panel 40 has a tab 42 struck from the upper edges thereof and inclined outwardly at an angle of approximately 10° so as to overlap the outer face of the front flange 44 of top wall 28, as best seen in FIGS. 8 and 10. A pair of holes 46 and 48 are provided in the upper corners of panel 40 to provide access for a socket wrench to reach the front pair of load frame mounting bolts 50 (FIGS. 8 and 10). Another pair of holes 52 are provided in the upper center of panel 40 for viewing the interior of the cabinet during servicing. A lower portion of front panel 40 has an inwardly extending channel shape section providing a shelf 54 and lip 56 for holding deodorant containers or cakes. A key operated electrical control switch 58 mounts in the upper right hand portion of panel 40. A drawer safety switch 62 is mounted on the upper ledge 64 of the deodorant shelf channel, interiorly of panel 40, and has a switch arm 63 (FIG. 13) which spans an opening 66 provided in panel 40 adjacent the right-hand edge thereof (as viewed in FIG. 8). A similar opening 68 is provided at the left-hand edge of panel 40. Each of the openings 66 and 68 have a tab bent inwardly along each vertical edge of the opening. Openings 66,68 are adapted to receive a pair of drawer-to-cabinet alignment guide ends described hereinafter.

A molded plastic control panel 70, of box-like configuration and open at the rear, is removably attached to panel 40 and covers the upper portion of the panel. Panel 70 has a downwardly extending flange 72 at the rear edge of its upper wall which is inserted between tab 42 and top wall flange 44, as best seen in FIG. 10. The bottom wall of panel 70 includes a molded flexible extension arm 74 having an upwardly extending finger 76 adapted to extend through an opening 78 in panel 40. Finger 76 has a camming surface adapted to flex arm 40 downwardly as panel 70 is hung on tab 42 then pivoted from an outwardly and downwardly inclined position to vertical position (in a clockwise direction as viewed in FIG. 10) during installation of panel 70 on panel 40. When it is desired to remove panels 70 for service, finger 76 is manually depressed to flex arm 74 downwardly.

Figure 9:
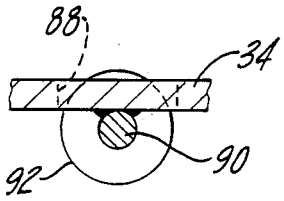
FIG. 9 is a fragmentary enlarged sectional view taken on the line 9—9 of FIG. 8.

The bottom wall 34 of the cabinet is provided with four leveling feet, one in each corner, in the form of a threaded hex nut 80 welded to the undersurface of bottom wall 34 in registry with an associated through-hole 82 (FIG. 8). A slot 88 (FIG. 9) is provided at the center, near the front edge, of bottom wall 34, and an axle pin 90 is welded to the undersurface of wall 34 so as to span slot 88 with its axis perpendicular to the direction of drawer travel. A single drawer roller 92 is journalled on pin 90 such that a small chordal portion of the roller protrudes above the upper surface of wall 34 (FIGS. 8, 9 and 10). The bottom wall 34 also has a cavity or indentation 94 in its upper surface aligned laterally with roller 92 near the rear edge of the wall. Cavity 94 is preferably formed by stamping a recess into the bottom wall to form the depressed portion 96, best seen in FIG. 10, for a purpose to be described hereinafter.

A pair of drawer guides or track channels 100 and 102 are affixed by spot welds to the interior surfaces of side walls 24 and 26 respectively so as to extend horizontally from front to rear cabinet about 2" above bottom wall 34. Tracks 100,102 are mirror images of one another and each comprise a C-shaped channel (see FIG. 7) having upper and lower horizontal flanges 104 and 106. As best seen in FIGS. 8 and 10, lower flange 106 is bent upwardly at the front end of the track to provide a drawer stop lip 108 aligned flush with the plane of the front edges of side walls 24 and 26. The front edge 110 of upper flange 104 is spaced rearwardly from lip 108 about 1½" to provide a drawer roller release space. Lower flange 106 at its rearward end is severed from the web of the channel 102 and formed in the last few inches thereof into a drop ramp portion 112 and a depressed horizontal terminal leg 114.

DRAWER BASKET CONSTRUCTION

Figure 6:
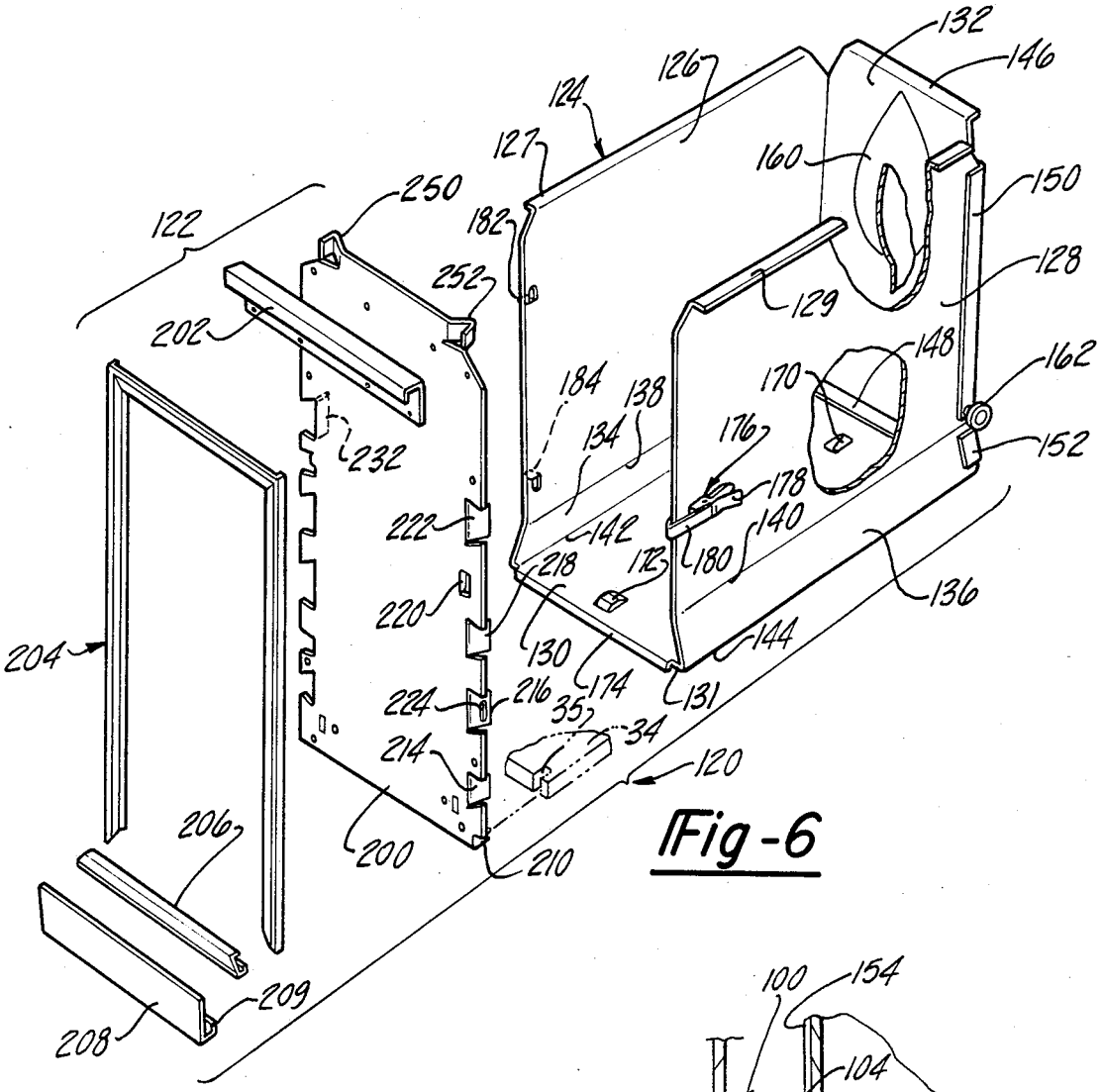
FIG. 6 is an exploded perspective view of the trash receptacle drawer.
Figure 7:
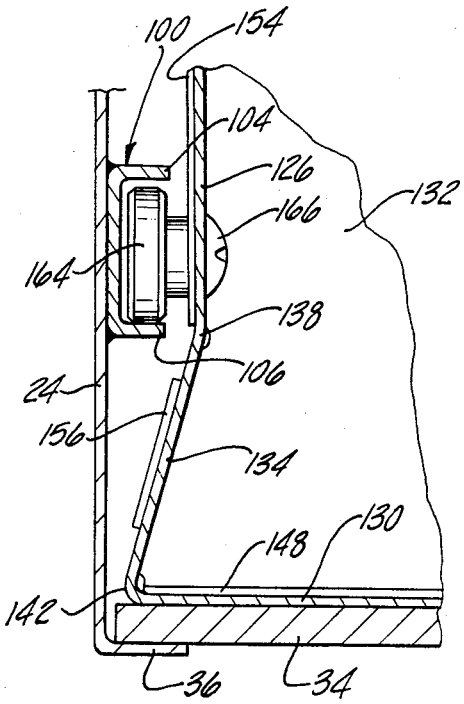
FIG. 7 is a fragmentary enlarged sectional view taken on the line 7—7 of FIG. 2.

Refuse compactor 20 is provided with a removable trash receptacle drawer and door sub-assembly 120 as shown in plan view in FIG. 2 and in the exploded perspective view of FIG. 6. Drawer 120 is of generally rectangular configuration with a hinged door sub-assembly 122 pivotable on a vertical axis between a closed position, shown in FIGS. 1 and 10, and an open position shown in FIG. 2. Drawer 120 also includes a drawer basket sub-assembly 124 fabricated primarily of sheet metal components of 0.065" thickness. Basket 124 comprises two upright parallel side walls 126 and 128 and a flat horizontal bottom wall 130 integral therewith. The upper edges of each of the side walls 126 and 128 are bent outwardly to form horizontal doubled-under stiffening flanges 127 and 129 respectively. An upright rear wall 132 is spot welded to the rear edges of the side walls 126 and 128 and the bottom wall 130. Side walls 126 and 128 have downwardly and outwardly tapering skirt portions 134 and 136 respectively which respectively extend between bend lines 138 and 140 and the bends 142 and 144 respectively which in turn define the outer side edges of bottom wall 130 and the lower edges of side walls 126 and 128. Skirts 134 and 136 thus taper outwardly and downwardly beneath the associated cabinet door tracks 100 and 102 when drawer 120 is installed in cabinet 22, as best seen in FIG. 7, such that the vertical portions of side walls 126 and 128 have a clearance with tracks 100 and 102 respectively.

Rear wall 132 is formed with a horizontal, rearwardly protruding doubled-under stiffening flange 146 at its upper edge, and a forwardly extending flange 148 at its lower edge which seats upon and is spot welded to the upper face of bottom wall 130 along the rear edge thereof. Each of the side edges of rear wall 132 has a pair of forwardly extending flanges, one pair of such flanges 150 and 152 along the right hand edge of wall 132 being visible in FIG. 6. The left hand edge pair of flanges of rear wall 132 appear as flanges 154 and 156 in FIG. 7. The upper flanges 150,154 overlap the vertically extending face of walls 128 and 126 respectively and are spot welded thereto. The lower flanges 152 and 156 lap over and are spot welded to the rear outer surfaces of skirts 136 and 134 respectively. It will thus be noted that the rear wall 132 is contoured to match the elevational outline contour defined by the side and bottom walls of basket 124.

Rear wall 132 is also provided with a somewhat teardrop shaped forwardly protruding bulge portion 160 which has a predetermined convex contour along the vertically extending centerline of the bulge matching the path of platen travel of the compactor mechanism as described subsequently herein.

A pair of Nylon drawer rollers 162 and 164 (FIGS. 6 and 7) are each mounted on a threaded Phillips or similar driving head stud 166 which extends through registering apertures in the rear edge of the associated side walls 126,128 and in flanges 150 and 154. Rollers 162 and 164 are adapted to track along and between the upper and lower flanges 104 and 106 of channels 102 and 100 respectively, as best seen in FIGS. 7 and 10.

Bottom wall 130 has a die-stamped depressed stop portion 170 having a generally V-shaped contour protruding downwardly below the underface of wall 130 (FIGS. 6 and 10). Stop 170 is adapted to nest in the cavity 96 of cabinet bottom wall 34, as shown in FIG. 10, when drawer 120 is disposed in its fully inserted position within cabinet 22. Stop 170 is thus aligned with the longitudinally extending centerline of the cabinet and is adapted to abut roller 92 and stop the drawer when it has been pulled out to its trash-loading position shown in FIG. 2.

Bottom wall 130 also has an upwardly die-stamped protruberance 172 (FIGS. 6 and 10) formed at its centerline so as to provide a nesting concavity registering with roller 92 in the fully inserted position of drawer 120 within cabinet 122 (FIG. 10). The front edge of bottom wall 130 is bent downwardly to form a stiffening flange 174 which abuts the front edge of bottom wall 34 in the fully inserted position of drawer 120.

Basket side wall 128 has a toggle-type door latch 176 spot welded to the outer face of wall 128. Latch 176 includes a pivotally mounted toggle handle 178 which carries a latch hook 180 pivotally thereon adapted to releasably engage door 122, as described subsequently. The other side wall 126 of basket 124 has a pair of outwardly protruding hinge ears 182 and 184 struck from the material of the side wall and bent outwardly therefrom, as best seen in FIGS. 3, 4 and 5. Hinge ears 182,184 have hinge pin holes 186,188 respectively which are vertically aligned with one another near the front edge of wall 126.

DRAWER DOOR CONSTRUCTION

Door sub-assembly 122 comprises a door panel 200, a door handle 202, and inverted U-shaped bright metal trim strip 204, a lower trim strip 206, and a toe kick molding piece 208. Door panel 200 preferably is a die-stamped flat sheet metal part made of galvanized steel having a gauge of say 0.065". A vertically aligned row of door-to-drawer basket alignment tabs are die-struck from each of the vertical side edges of door panel 200, as best seen in FIGS. 3 and 6. Thus, in ascending order, the right hand edge of door panel 200, as viewed in FIG. 6, has a tab 210 bent inwardly perpendicularly from the plane of panel 200 adjacent the bottom edge thereof. Tab 210 is formed with a V-shaped notch 212, as shown in the fragmentary phantom view of FIG. 8. Next, there are three vertically spaced tabs 214,216 and 218 which are bent inwardly from the plane of panel 200 at an obtuse included angle of about 100° so as to overlap the outer face of the vertical front edge of basket wall 128 in the closed condition of door 122. Next, a tab 220 is struck from panel 200 so as to protrude inwardly therefrom at an acute included angle of say 80° to panel 200, so as to overlap the inner face of the front edge of basket side wall 128. Finally, another tab 222 is bent inwardly from panel 200 above tab 220 at the same angle as tabs 214,216 and 218. The angulation of the tabs 220 and 222 with panel 200 is best seen in FIG. 2. Tab 216 is provided with a vertical slot 224 which is adapted to be engaged by the hook-end 180 of door latch 176.

The left hand edge of door panel 200 is similarly die-struck and formed to provide a vertical row of door-to-drawer basket alignment tabs 226,228 and 230, as shown in FIG. 3, which are bent inwardly at an obtuse included angle to panel 200 so as to lap the outer face of basket side wall 126 in the closed position of door panel 200. In FIG. 3 a portion of tab 230 and panel 200 has been cut away, and a segment of basket side wall 126 shown shifted outwardly in phantom, to better illustrate the overlapped condition of tab 230 with side wall 126 in the closed condition of door panel 200 relative to basket 124. An additional door-to-drawer alignment tab 232 (shown in FIG. 2 in solid lines and in phantom in FIG. 6) is provided as the uppermost tab of the left hand edge row and is bent at the same angle as tabs 226,228 and 230. A pair of hinge tabs 234 and 236 are bent inwardly from panel 200 perpendicularly thereto, and each hinge tab has a hinge ear 238 and 240 respectively bent perpendicularly to the plane of associated tab 234 and 236, and the same are provided with aligned hinge pin holes 242 and 244. In the assembled condition of door panel 200 to basket 124, upper door hinge tab 240 rests upon upper hinge ear 182 with pin holes 244 and 186 registered with a hinge pin rivet 246 inserted therethrough. Lower door hinge tab 238 is disposed beneath lower hinge ear 184 and pin holes 238 and 188 are likewise registered and the hinge pin rivet 248 inserted therethrough (see also FIG. 4 and FIG. 5).

The upper edge of door panel 200 is also die-struck and formed to provide a laterally spaced pair of drawer-to-cabinet alignment projections 250 and 252. In the embodiment shown in FIGS. 2 and 6, projections 250 and 252 are formed as inwardly protruding U-shaped tabs adapted to self-align drawer 125 to cabinet 22 upon entry into associated registered relation with the tab openings 68 and 66 respectively in panel 40 as drawer assembly 120 is drawn tightly to closed position by operation of the two drawer rollers 162,164 rolling down the associated track ramps 112 and the inclined surface of concavity 172 riding down roller 92. Tab 252 is disposed relative to the arm 63 of door safety switch 62 in such closed condition of the door to move the switch arm to closed, energizing position.

Figure 13:
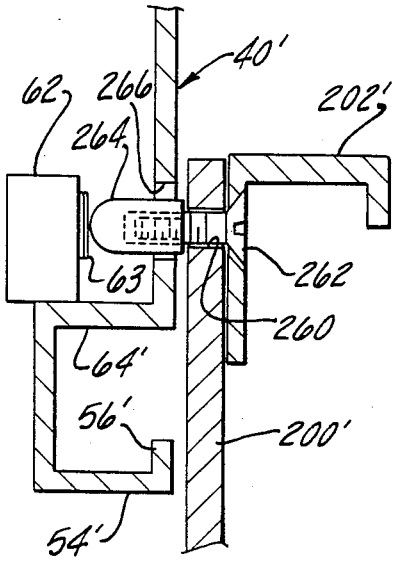
FIG. 13 is a fragmentary vertical cross sectional view of a slightly modified form of door/drawer-to-cabinet self-alignment structure.

As shown in FIG. 13, a modified form of drawer-to-cabinet self-alignment structure may be employed as an alternative to alignment tabs 250 and 252 and the corresponding tabs 66 and 68 of panel 40. In FIG. 13 those elements corresponding to structure previously described have been given the same reference numerals with a prime suffix and the description not repeated. Instead of integrally formed ears 250 and 252, door panel 200' is provided with a pair of laterally spaced apertures 260 at approximately the same location as tabs 250 and 252 of panel 200. Door handle 202' also has apertures registering with the door panel openings 260, and a pair of mounting screws 262 are inserted through the registering apertures. Internally threaded alignment pins 264 are threaded one onto each of the inwardly protruding shanks of screws 262 to secure these parts to door panel 200' as wall as to fasten handle 202' to the door panel. Each pin 264 is provided with a bullet-shaped nose to facilitate entry of the pins into associated alignment openings 266 provided in cabinet front panel 40' at approximately the same location as tabs 66 and 68 of FIG. 8. Each opening 266 comprises a vertically extending oblong slot having parallel vertical side edges which have a close clearance fit with the cylindrical dimension of the associated pin 264. However, slot 266 has a vertical dimension substantially greater than the diameter of pin 264. This arrangment enables pin 264 to enter the slot 266 and then drop down in the slot as the drawer 120 rolls shut down the drawer-guide drop-ramps while still maintaining the close side-clearance fit which prevents lateral shifting of the door relative to the cabinet in the closed condition of the door, i.e., the cylindrical surface of pin 264 and vertical side wall of opening 266 insures that no door-opening force components are generated in response to lateral reaction forces exerted between the drawer and cabinet during compaction.

Referring again to the door-sub-assembly 122 shown in FIG. 6, the door handle 202 generally comprises a channel-section of generally inverted J-shape affixed by sheet metal screws to the outer face of door panel 200 along its upper edge, as best seen in FIGS. 1 and 10. The bright metal trim strip 204 is a light-gauge roll-formed piece having a cross sectional configuration as best seen in FIG. 4. Thus, trim strip 204 has an inturned flange 270 running along its interior edge, and another flange 272 running along its exterior edge extending oppositely to flange 270 and staggered therefrom so as to overlap the interior face of door panel 200. Sheet metal screws or rivets 274 are inserted from the interior side through trim flange 272 into door panel 200 to fix trim strip 204 thereto with flange 270 abutted flat against the outside exterior face of panel 200. Trim strip 204 thus provides a decorative trim for the door panel 200 and serves to cover both the screws or rivets 274 and the tab notches struck from each of the vertical side edges of the door panel 200 and stiffens door panel 200. If desired, trim strip 204 can also be employed to mount plastic or sheet metal decorative color panels onto the exterior surface of door panel 200. The lower trim strip 206 has a cross-sectional configuration as best seen in FIG. 10 and is affixed by sheet metal screws 207 to door panel 200 to extend between the vertical legs of strip 204 across the bottom panel 200. The toe-kick strip 208 is preferably a black molded plastic part affixed by a lip flange 209 and screws 207 to door 200 and the front lower face of trim strip 206, as shown in FIGS. 1, 6 and 10.

OPERATION OF DRAWER, DOOR AND CABINET SUBASSEMBLIES

Assuming that the drawer-door sub-assembly 120 has been assembled as described previously, the same is installed in cabinet 22 by inserting it rear-end first slightly into the front opening of the cabinet defined between the front edges of bottom wall 34, side walls 24 and 26 and front panel 40. This may be readily accomplished by manually gripping handle 202 and rear basket flange 146 and then lifting the drawer so as to place rollers 162 and 164 into the front ends of associated tracks 102 and 100 so that the rollers are rested upon lower track flanges 106 adjacent stops 108. In this position, the rear portion of the undersurface of the drawer bottom wall 130 will be resting upon roller 92. The front end of drawer 120 may be lowered until the flange 174 rests upon the floor surface on which compactor 20 is supported by feet 84, thus tilting drawer 120 slightly downwardly and away from cabinet 22. In this "trash bag unloading" position, the upper perimeter and interior of drawer 120 is readily accessible for installation of the trash bag liner of the type hitherto employed with the aforementioned Montgomery Ward "Signature" trash compactor. This is also the position in which the bag, when fully loaded with compacted trash, is removed from the drawer after opening of door 122.

Assuming that an empty trash liner bag has been installed in the drawer basket 124 with door 122 in its open position (FIG. 2), drawer 122 is swung to closed position (FIGS. 1 and 10), and hook 180 of door latch 176 is engaged in tab slot 224 with latch handle 178 in its forward released position. Handle 178 is then pivoted rearwardly to draw hook 180 rearwardly through the toggle action of the latch. This causes the door panel to be drawn tightly against the front edges of basket 124. As this pivotal closure movement is occurring, alignment tabs 214,216,218,222 lap the exterior surface of side wall 128, and tab 220 laps the interior surface of the side wall. Simultaneously, the alignment tabs 226,228,230 and 232 along the left side of door 200 come into lapping contact with the exterior side of side wall 126 of the basket. Also, the notched portion 212 of the bottom tab 210 of the door will embracingly engage the front edge of basket bottom wall 130 at a point indicated 131 in FIG. 6. Note that the front edge of cabinet bottom wall 34 is provided with a notch 35 (FIGS. 6 and 8) to furnish clearance for tab 210 in the fully inserted position of drawer 110,120 in cabinet 20. The aforementioned tab engagement of the door and basket produces a secure self-alignment therebetween due to the wedging action of the tabs 214,216,222 relative to tab 220 and the notch engagement of tab 210 and wall 130.

With the empty trash bag liner installed in basket 124 and with door 122 firmly latched and engaged with the front edge of basket 124, the user then lifts the front edge of drawer 120 by handle 202 and also pushes the drawer rearwardly into the space in cabinet 22 provided beneath the upwardly retracted power unit of the compactor (phantom position of same shown in FIG. 10). As the drawer is thus inserted into the cabinet, rollers 162,164 roll along tracks 102,100, thereby carrying the weight of the rear half of the drawer. During initial rearward movement lifting the drawer 120 to a slightly upwardly tilted condition allows abutment 170 to clear roller 92. Once abutment 170 has been moved inwardly of the cabinet past roller 92, drawer 120 is lowered to rest drawer bottom 130 on roller 92 such that further inward movement of the drawer into the cabinet is entirely a three-point roller supported movement.

During the last half inch or so of inward movement of the drawer 120 into cabinet 22 toward the drawer-closed compacting position shown in FIGS. 1 and 10, rollers 162,164 will engage and ride down the track ramps 112, and drawer floor ramp 173 of concavity 172 will simultaneously come into registry with roller 92, thereby allowing the entire drawer 120 to settle downwardly into rest position with drawer bottom 130 resting flat on cabinet bottom wall 34. At this point, abutment 170 will be registered within cavity 94 in cabinet bottom 34. Likewise, door alignment tab 210 will be registered in the recess 35 of cabinet bottom 34. The drawer-to-cabinet alignment ears 250 and 252 will have entered into registry with openings in front panel 40 so as to overlap the associated alignment tabs 68 and 66 to thereby lock the door and hence drawer against lateral shifting relative to the cabinet 22. In addition, tab 252 will have engaged the arm of safety switch 62 so that the power unit circuitry is enabled for operation. In the case of the modified embodiment of FIG. 13, alignment pins 264 will have entered the slots 266 to self-align and lock the door in proper position and hold the same immobile against lateral shifting forces. Compactor 20 is thus ready for an operation through a compacting cycle, as will be described in more detail hereinafter.

After the completion of the compaction cycle, with the power unit retracted (phantom position, FIG. 10), drawer 120 may be readily pulled forwardly outwardly of cabinet 22 merely by the user gripping handle 202 with one hand and pulling outwardly in a horizontal direction. This will cause rollers 162,164 and the rearward underface of hump 172 to ride up on the associated ramps 112 and roller 92 thereby initially lifting drawer 120 about ¼" as it is moved forward about ½". Thereafter rollers 162 and 164 will track along flanges 106 as bottom wall 130 of the drawer rolls along roller 92. In this condition, abutment 170 has a slight clearance with cabinet bottom 34. When drawer 120 has been pulled outwardly far enough to bring abutment 170 into contact with roller 92, this engagement will cause further outward movement of the drawer to be obstructed unless the user lifts the drawer slightly upwardly to tilt it upwardly. Hence, drawer 120 will normally be halted in this position, which is the trash loading position shown in FIG. 2. In this position, the open upper end of the drawer is now accessible exteriorly of compactor 20 for loading with loose pieces of trash and/or garbage.

However, if drawer 120 contains a full load of compacted trash, the user will lift the front end of the drawer by handle 122 to assist abutment 170 in clearing roller 92 as the drawer is pulled further outwardly until rollers 162,164 engage the track stops 108, whereupon the user lowers the drawer to rest its front edge upon the floor. The drawer now assumes the trash-unload position described previously. If desired, the drawer may be completely removed and separated from cabinet 22 by gripping rear flange 146 and front handle 202 to lift the drawer and hence rollers 162,164 over the stops 108 and out of the tracks 100,102. In order to unload a trash bag liner which is full of compacted trash, door 122 is released by operating the door latch 176 to release it from engagement with door tab 216, and then door 122 is swung to open position shown in FIG. 2.

COMPACTING MECHANISM

The embodiment of the trash or refuse compacting mechanism of refuse compactor 20 shown in FIGS. 8, 10, 11 and 12 generally incorporates several features, such as the movable motor, lead screw drive mechanism and associated toggle linkage, of the aforementioned Moon patents as well as certain features of the aforementioned Wolbrink et al patent and the commercial embodiments thereof as exemplified by the aforementioned Montgomery Ward "Signature" trash compactor service manual publication, all of the above being incorporated herein by reference. However, the present invention also embodies many improvement features over the aforementioned prior art, including but not limited to the drive mechanism for the linkage, the cabinet-to-linkage suspension framework and in the compacting platen and electrical system, in addition to improvements in the previously described cabinetry and drawer construction.

Referring first to FIGS. 8 and 10, the compacting mechanism of compactor 20 comprises the same type of extensible linkage disclosed in the aforementioned Moon '890 patent, namely, a system of two identical extensible linkages laterally spaced from one another within the cabinet. Each linkage consists of two identical five-bar linkages wherein the fifth bar of each linkage consists of a variable link element which is common to both of the five-bar linkages; i.e., a threaded screw 300 corresponding to screw 80 of the Moon '890 patent. However, as in the aforementioned "Signature" trash compactor the lead screw 300 extends axially in the same direction as drawer movement instead at right angles thereto as shown in the exemplary embodiments illustrated in the aforementioned Moon and Wolbrink et al patent. However, one major and very important difference between the present invention and the aforementioned prior art is that the drive motor 302 of the compacting mechanism of the present invention is mounted beneath rather than above lead screw 300, i.e., in the space between the two laterally spaced sets of toggle linkages and vertically between lead screw 300 and the compacting platen sub-assembly 304.

Figure 11:
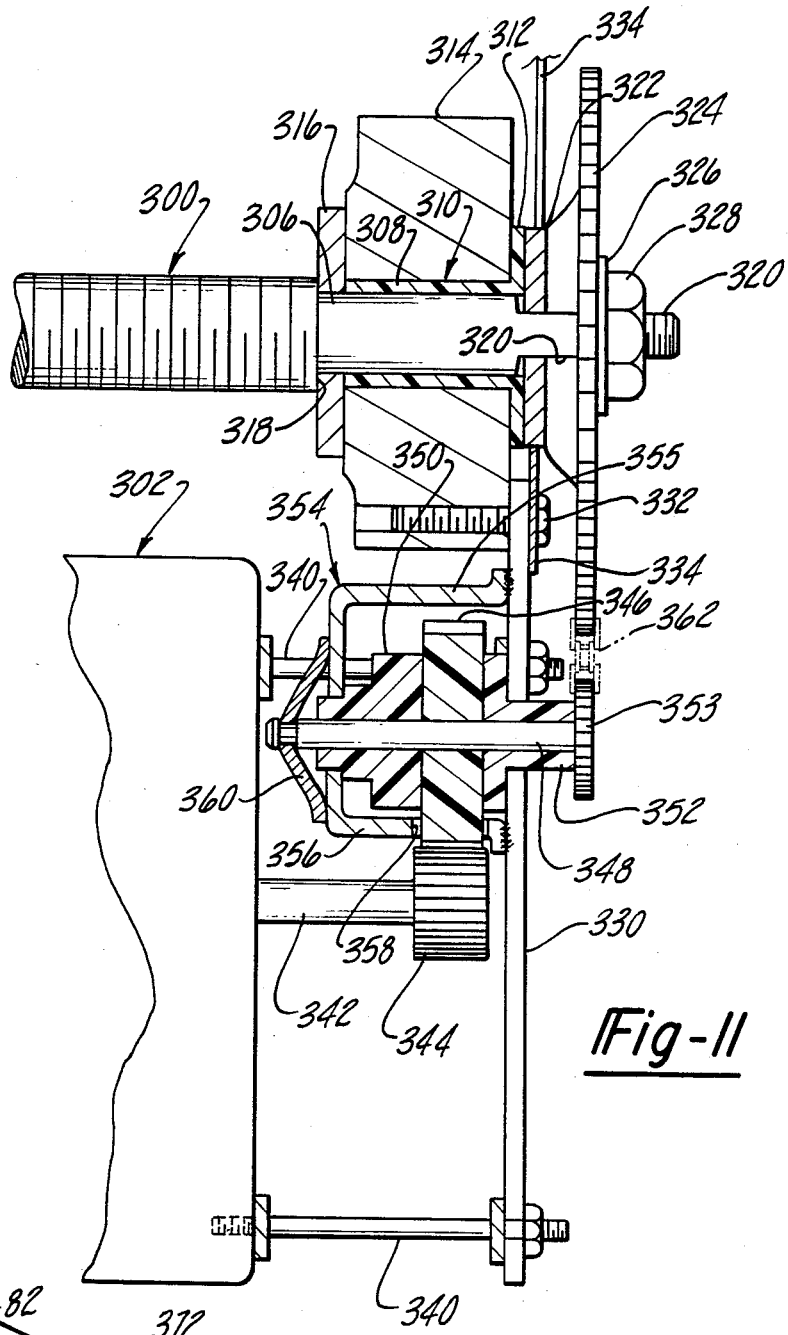
FIG. 11 is an enlarged fragmentary elevational view, taken partly in center section, of the motor and associated gear and chain drive train of the compacting mechanism.

As best seen in FIG. 11, lead screw 300 is of the acme thread type disclosed in Wolbrink et al U.S. Pat. No. 4,100,850 and has at the forward end of the screw a smooth bearing portion 306 within the sleeve portion 308 of a combination thrust bearing and sleeve bushing 310, preferably made of plastic material, such as Nylon plastic. An integral flange 312 at the forward end of sleeve 308 serves as a thrust washer. Sleeve 308 is in turn received within the through opening of the die-cast bearing block 314, which corresponds to the bearing block 52 of the aforementioned Wolbrink et al patent and bearing block 110 of the Moon patent. A steel reversing force thrust washer 316 is received on shaft portion 306 and is captured between bearing block 314 and a shoulder 318 of screw 300 and a plastic thrust washer of the present version is deleted. Screw 300 has a further reduced-diameter terminal stud portion 320 with a threaded end on which is received in assembly a steel thrust washer 322, a larger diameter chain sprocket 324 of the gear-sprocket-chain drive train, a washer 326 and nut 328. Sprocket 324 is suitably keyed or pinned to shaft 320.

In accordance with another improvement feature of the present invention, a simplified open gear box assemby is provided consisting of a stamped, flat plate 330 cantilevered mounted to bearing block 314 by a pair of self-tapping or thread-cutting mounting bolts 332. These bolts replace more costly socket head through-bolts and nuts of the prior unit. A thin, flat less costly switch mounting bracket 334 is also cantilever mounted to block 314 by bolts 332. Bracket 334 is notched to extend around washer 322 and upwardly above sprocket 324 to mount a pair of limit switches 336 above bearing block 314, seen in FIGS. 8 and 10. An associated pair of switch arms 338,340 project in cantilever fashion from switches 336 and their free ends are adapted to operatively impinge the undersurface of cabinet top wall 28 in the fully raised position of the compacting linkage, as indicated in the phantom showing in FIG. 10.

Motor 302 is cantilever mounted in spaced relation to plate 330 by four motor mounting studs or pins 340 disposed in a rectangular array, two of the same being shown in FIG. 11. The drive shaft 342 of motor 302 carries a metal pinion 344 which meshes with a larger plastic pinion gear 346 which in turn is keyed to a shaft 348. Shaft 348 is journalled for rotation in plastic bushing thrust washers 350 and 352 which flank gear 346. The sleeve of bushing 352 extends through an aperture in plate 330 and its outer end abuts the small chain sprocket 353 which is cast integral with shaft 348 for rotation therewith. The sleeve of bushing 350 extends through an aperture of a U-shaped bracket 354 the legs 355 and 356 of which are welded at their feet to plate 330. The lower leg 356 of bracket 354 is slotted at 358 to accommodate pinion 346. A push-on retainer 360 is received on the rearward end of shaft 348 and abuts the bight of bracket 354. Shaft 348 may be grooved to retain washer 360 as shown, or, alternatively, a push-on retainer washer may be used and the groove eliminated. The drive train is completed by a chain 362 trained around sprockets 324 and 352.

Figure 12:
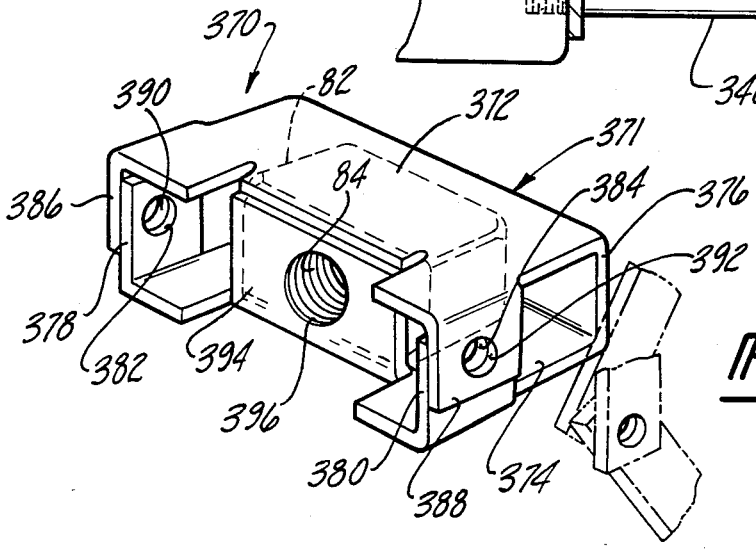
FIG. 12 is a perspective view of the traveling nut and rear trunnion of the compacting mechanism shown by itself with a portion of the associated linkage of the compacting mechanism shown in phantom and exploded relation to the traveling nut.

As best shown in FIG. 12, another improvement feature of the present invention is the simplified rear trunnion floating nut assembly 370. The purpose and function of this floating nut assembly is set forth in the aforementioned Wolbrink et al U.S. Pat. No. 4,100,850 wherein the rear trunnion 50 containing nut 82 is described, and the same is incorporated herein by reference. Housing 371 of trunnion 370 replaces Wolbrink et al housing 94 for receiving nut 82 and for restraining the nut from rotation with the lead screw 300 described herein. Like housing 94 of Wolbrink, the present trunnion assembly 370 also permits limited pivotal movement of nut 82 with respect to the housing 371 and provides flexural properties which permit the absorption of shocks and eccentric loading on the compacting linkage.

Housing 370 is made in one piece of heavy gauge sheet metal in a die-stamping and bending operation and comprises two spaced parallel walls 372 and 374 integrally connected by a bight wall portion 376. The outer free edge corners of wall 374 are formed with a pair of ears 378 and 380 which are bent perpendicularly upwardly from the plane of wall 374 and provided with axially aligned bolt holes 382 and 384 respectively. Likewise, the outer free edge corners of wall 372 are provided with a pair of ears 386 and 388 which are bent downwardly from the plane of wall 372 so as to outwardly overlap and embrace ears 378 and 380 respectively. Ears 386 and 388 are likewise provided with bolt holes 390 and 392 which align with holes 382 and 384. A central portion of the free edge of wall 374 is also bent upwardly from the plane of wall 374 to form a nutretaining closure tab 394. A center aperture 396 in tab 394 is axially aligned with the corresponding aperture (not shown) in bight wall 376 for receiving lead screw 300 therethrough with a loose clearance. The nut 82 of Wolbrink et al has a threaded hole 84 for mating with lead screw 300, this nut being inserted in the space between walls 372 and 374 before the final bending operation wherein tab 394 is bent upwardly to loosely capture the nut within the cavity. An alternate assembly method is to behd tab 394 first and the slide nut 82 through the side opening between wall 376 and side ears 380 and 388. Tab 394 may be welded to wall 372 for added strength. Only one opening and one weld may be utilized. Rear trunnion 370 is preferably connected to the associated links of the compacting linkage by the same nuts 128 and bolts 130 shown in FIG. 2 of the Wolbrink et al patent.

As shown in FIG. 10, in accordance with another feature of the present invention a motor start capacitor 390 is mounted by a spring clasp (not shown) directly to the exterior face of the die cast frame or end bell 399 of the motor assembly 302. The capacitor 398 is thus electrically connected in circuit with the motor by short wiring leads which are secured to the motor assembly. Hence, by so mounting capacitor 398 the power unit wiring is shortened and the number of leads running in the flexible connector between the power unit and the cabinetry electrical connections are reduced.

Another feature of the present invention is the use of automatic reversal of the compacting mechanism instead of using an additional electrical switch as mounted on front trunnion 314 in the prior unit. Reversal of the present unit when the basket is empty or nearly so is accomplished by allowing the screw 300 to pull trunnions 314 and 371 tightly together so as to slow the motor 302 enough to cause the centrifugal switch within the motor to operate reversal of the motor and thus retraction of platen 304. Such reversal is thus accomplished in the same manner as occurs in both the present and prior units when there is sufficient volume of compacted trash in the basket so as to prevent trunnions 314 and 371 from closely approaching each other.

PLATEN ASSEMBLY

In order to accommodate the mounting of motor 302 beneath screw 300, rather than above the same as in the prior art, the present invention provides an improved platen assembly 304 as shown in FIGS. 8 and 10. Platen 304 comprises a one-piece heavy metal member, preferably made from galvanized steel of 0.125" thickness, which is die-stamped and formed into a rectangular, generally flat bottom wall 400 having a row of laterally extending, longitudinally spaced reinforcing ribs 402 formed therein. The side edges of bottom wall 400 are integrally joined to side walls 404 and 406, and likewise the end edges of bottom wall 400 are integrally joined to end walls 408 and 410. Side walls 404 and 406 are bent upwardly from wall 400 and taper inwardly at a slight angle toward one another. Front end wall 408 is bent upwardly perpendicularly to wall 400 and its inner face laps against and is welded to the end edges of side walls 404 and 406. Rear end wall 410 is tapered inwardly and upwardly from wall 400 at a somewhat smaller acute angle than wall 408 and is welded to the rear end edges of side walls 404 and 406. The junction 412 (FIG. 10) of rear and bottom walls 410 and 400 has a smooth curvature of relatively large radius, and preferably provided with a smooth surface to minimize the danger of snagging the trash bag in the event of rubbing contact between edge 412, the bag and the apex of basket wall bulge 160.

Platen subassembly 304 also includes four struts 414,416,418 and 420 rigidly secured by welding into the four corners of the platen so as to extend upwardly therefrom. The front struts 414 and 416 extend rearwardly at an incline to floor 400 and parallel to one another. Rear struts 418 and 420 extend upwardly and forwardly at an incline to floor 400 and parallel to one another. Front struts 414 and 416 have clevice brackets 422 and 424 welded thereto at their upper ends. The lower end of a link bar 426 is received between clevice bracket 422 and the upper end of strut 414 (FIG. 8), and is pivotally connected thereto by a hinge pin 428. Likewise, the lower end of link bar 430 is received between clevice bracket 424 and the upper end of strut 416 and is pivotally connected thereto by hinge pin 432 (FIG. 10). The lower ends of rear link bars 434 and 436 (FIGS. 8 and 10) are respectively connected by a hinge pin cross shaft 438 to the upper ends of struts 418 and 420.

Preferably, platen subassembly 304 is also equipped with a four-sided sheet metal skirt 442 (shown in phantom in FIG. 10) which wraps around the upper edges of platen walls 404–410 and is spot welded thereto as well as to the outer sides of the struts 414–420. Skirt 442 is provided with an outwardly extending stiffening flange 444 running around its upper periphery. Skirt 442 serves as a shield to help prevent loose pieces of trash from climbing up and over the side and end walls 404–410 and deposited on platen bottom 400.

The extension of platen wall 400 from the compactor linkage via struts 414–420 provides a clearance space to accommodate nesting of motor 302 in the collapsed condition of the toggle linkage shown in phantom in FIG. 10. Thus, in accordance with a principal feature of the present invention, compactor 20 is able to utilize a compacting mechanism equipped with a drive motor, drive train, lead screw and toggle linkage functionally similar to that disclosed in the aforesaid Moon U.S. Pat. No. 3,714,890, but such mechanism inverted from that shown in the Moon patent. To facilitate understanding, the link bar elements of such toggle linkage, in addition to links 426, 430, 434 and 436 already described, include lower stabilizer links 446 and 447, upper crossed links 448, 450, 454 and 456 and upper stabilizer links 452 and 453 connected as shown in FIGS. 8 and 10. As viewed in FIG. 10, these scissor linkage elements correspond as follows to the linkage elements as shown and numbered in FIG. 1 of the Moon '890 as follows: 430-84, 436-82, 446-86, 448-88, 450-90, and 452-92. The opposite side of the linkage seen in FIG. 8 has a similar correspondence to the linkage elements of the compacting mechanism of the Moon patent.

CABINET MOUNTING AND SUSPENSION OF POWER UNIT

In accordance with a further feature of the present invention, the above-described compacting mechanism power unit is removably mounted and suspended directly from the side walls 24 and 26 of cabinet 22 by a load frame assembly 460 best seen in FIG. 8. Load frame 460 includes a pair of parallel cylindrical shafts 462 and 464 spaced fore and aft of the cabinet and extending perpendicularly to side walls 24 and 26. The upper ends of the front upper links 450 and 454 are pivotally mounted on front shaft 462, and the upper ends of rear links 448 and 456 are pivotally mounted on the rear shaft 464. A pair of laterally spaced and longitudinally extending rails 466 and 468 are apertured at their front and rear ends to respectively receive shafts 462 and 464 therethrough. Rails 466 and 468 are disposed closely adjacent to but inwardly of associated links 454,456 and 448,450 respectively, and the rails are tack welded to shafts 462 and 464. A pair of front and rear cross beams 470 and 472 are respectively abutted and welded to the front and rear ends of rails 466 ahd 468 and extend parallel to and terminate flush with, the ends of the associated shafts 462 and 464. A pair of mounting brackets 474 and 476 are spot welded to the interior surfaces of cabinet walls 24 and 26 closely adjacent top wall 28 and parallel thereto. Each bracket 474,476 has a pair of end flanges 478 and 480 extending inwardly from the cabinet perpendicular to the cabinet side walls and provided with bolt holes for receiving mounting bolts 50 which extend through registering holes in beams 470 and 472 to thereby removably secure the cross beams to the mounting brackets and thus the load frame to the cabinet.

As best seen in the fragmentary break-away showing in FIG. 8, each of the ends of the beams 470 and 472 are notched out so as to provide a rigid finger 482 which abuts the under surface of the associated bracket 474,476. Likewise, the ends of shafts 462 and 464 are disposed beneath and in close clearance for abutting relationship to the undersurfaces of bracket 474 and 476. As described hereinafter, the reaction forces exerted via the power unit during its downward compaction stroke are transmitted via the abutment of fingers 482 and the ends of shafts 462 and 464 with the underedges of brackets 474 and 476 such that loading of the brackets and cabinet side walls is primarily a shear stress.

It is also to be noted that rear beam 472 of load frame 460 has a vertical dimension in assembly greater than that of front beam 470 such that its lower edge is adapted to be abutted by upper stabilizer links 452 and 453 in the almost fully retracted position of the compacting mechanism. Such abutment may occur prior to shutoff of the mechanism via switch 340 because, due to various clearances and manufacturing tolerances present in the power unit linkage and the weight of the motor 302 on the front end, the rear end of the linkage will travel slightly out-of-phase with the front end of the linkage and thus reach its upper limit of travel in advance of the front end. Hence, abutment of the rear stabilizer links with rear beam 472 causes continued retraction drive of the linkage to swing the front end of the linkage upwardly to its fully raised position, thereby insuring that switch arms 338,340 are brought into operative contact with cabinet top wall 28 to shut off motor 302 before abutment of the front of the linkage with front beam 470.

Figure 15:
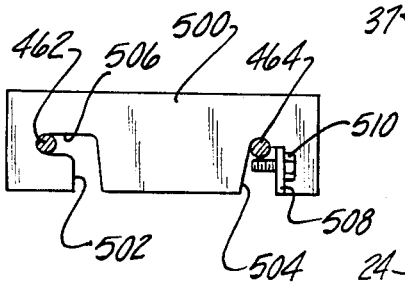
FIG. 15 is a sectional view taken on the line 15—15 of FIG. 14.
Figure 14:
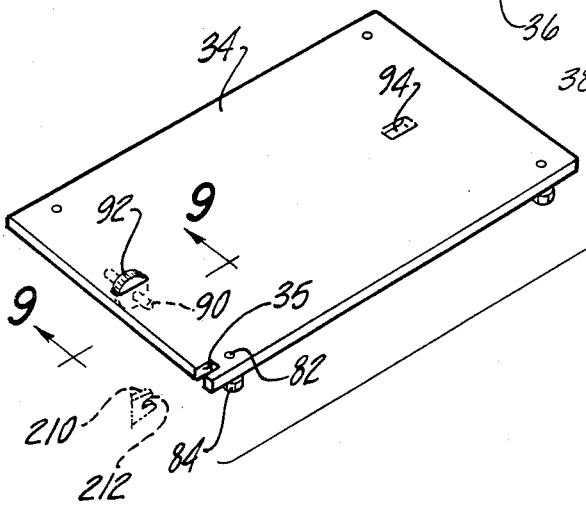
FIG. 14 is a perspective view, with a portion broken away, of a modified embodiment of a portion of the load frame sub-assembly of the present invention.
Figure 14:
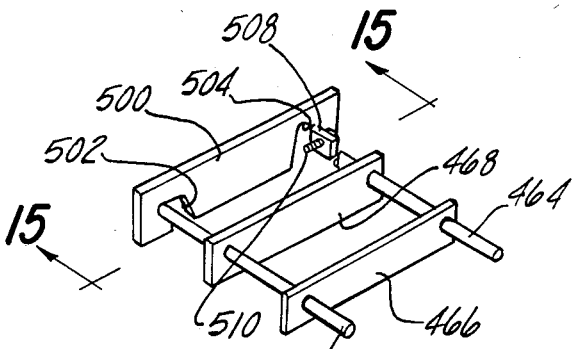

FIGS. 14 and 15 illustrate an alternate embodiment of load frame sub-assembly 460 wherein a modified pair of cabinet brackets 500 are provided in place of brackets 474 and 476. Bracket 500 shown in FIGS. 14 and 15 represents the bracket for the left-hand side (as it would be viewed in FIG. 8) of the load frame. Another bracket (not shown), which is a mirror image of bracket 500, is employed on the right-hand side of the unit in place of bracket 476. The modified brackets 500 are, like brackets 474 and 476, spot welded to the inner surfaces of cabinet walls 24 and 26 closely adjacent top wall 28 and parallel thereto. Bracket 500 comprises a rectangular steel plate having front and rear slots 502 and 504 formed therein for receiving the ends of front and rear load frame shafts 452 and 464 respectively. Front slot 502 is in the form of a dog-leg having a vertical entrance leg and a horizontal blind-end leg 506 extending forwardly therefrom (FIG. 15). Rear slot 504 is a straight vertical slot but may have a slight convergent taper towards its upper end. The blind ends of slots 502 and 504 are dimensioned to receive with a close clearance fit the ends of shafts 462 and 464. A struck and bent out tab 508 extends perpendicularly from the rear edge of slot 504 and is provided with a threaded opening to receive a keeper stud 510 therethrough for releasably retaining the ends of shaft 464 within the associated rear slot 504. Thus, with the modified load frame of FIGS. 14 and 15, the compactor mechanism power unit is removably mounted to the cabinet side walls without requiring the use of cross beams 470 and 472 or the four mounting bolts and associated nuts 50.

Assuming the compacting mechanism is mounted with shafts 462 and 464 positioned as shown in FIGS. 14 and 15, to remove the power unit for servicing, drawer 120 and rear panel 130 are first removed from cabinet 22 and then the same is placed upside down. With the power unit toggle linkage in either extended or retracted condition, keeper studs 510 are backed off clear of shaft 464, thereby enabling the serviceman to pivot the power unit in a clockwise direction as viewed in FIG. 8 and thus withdraw the ends of shaft 464 from the associated rear slots 504 of brackets 500. With the power unit thus slightly pivoted out of mounted position, and shaft 464 disengaged from brackets 500, the power unit can be slid rearwardly a short distance to move front shaft 462 into registry with the vertical portion of slots 502, whereupon the entire power unit may be lifted to withdraw the ends of shaft 462 out of engagement with brackets 500. Once free of the mounting brackets, the entire power unit is then lifted and tilted to withdraw the same through the front opening of the cabinet. To install the compacting mechanism power unit in the cabinet, the above procedure is merely reversed.

With the modified embodiment of FIGS. 14 and 15, rails 466 and 468 may be made of thinner and lighter stock because they are subjected only to tensile loading as distinguished from the tensile and bending loads imposed on these parts in the embodiment of FIG. 8. Shafts 462 and 464 may be increased slightly in diameter and/or hardened to better adapt the same to their higher loading in the modified embodiment of FIGS. 14 and 15.

OPERATION OF COMPACTING MECHANISM

The improved refuse compactor 20 of the present invention is adapted to be equipped with the electrical circuitry and control mechanism disclosed in the aforementioned Moon patents and/or the aforementioned Montgomery Ward "Signature" Trash Compactor service bulletin. Hence, for brevity operation of the above-described compacting mechanism is not herein described in detail. However, 20 it is to be noted that platen 304, as in the aforementioned prior art refuse compactors, defines a path of travel which is slightly curved as indicated by the arrow head broken line 490 in FIG. 10 which extends between the solid and phantom line showings of the platen in its fully lowered and fully raised positions respectively. The rounded rear edge 412 of platen 304 likewise travels through a path indicated by the dashed line 492 in FIG. 10. As indicated previously, the apex of the vertical centerline of the inward bulge 160 of the basket rear wall 132 in the fully inserted position of drawer 120 extends parallel to path 492 and is spaced therefrom about ¼". Hence, so long as platen 304 is traveling or stationary anywhere within basket 124, such that edge 412 is at or below rear basket flange 146, drawer 120 cannot be moved outwardly from fully inserted position more than the aforementioned ¼" spacing (plus a small added amount due to manufacturing and wear-in clearances in the pivot pin-to-linkage assemblage). This feature eliminates the need for a drawer-to-cabinet latch mechanism hitherto required because of the possibility, in the prior art compactor, of the drawer opening about 2" at certain positions of the platen were such latching mechanism absent, or in the event of malfunction of the same.

ADVANTAGES OF THE INVENTION

In addition to the several advantages resulting from the features as described hereinabove, the compactor 20 of the present invention provides the following specified features and advantages over the above-identified current production commercial "Signature" brand compactor (hereinafter termed "prior unit"):

1. Cabinet 22

(a) The exterior dimensions of cabinet 22 are significantly reduced, i.e., the horizontal lateral dimension is reduced approximately 17%, the vertical or height dimension is 7% less and the front-to-rear or horizontal depth dimension is 4% less to thereby likewise reduce the kitchen cabinet space required for installation. The number of individual piece parts is reduced approximately 39% and the weight is reduced approximately 26%. The reductions in size and weight for the same compacting capacity also reduce shipping space and costs.

(b) The floor or bottom wall 34 of the cabinet is greatly simplified and merely consists of one, relatively heavy steel plate as compared to a multi-piece built-up box section structure with a corrugated reinforcing member sandwiched between top and bottom plates and extensive welded connections. Because floor 34 spans a smaller cabinet width dimension essentially equal to basket width, smaller bending loads are imposed on the floor and hence the single flat plate provides sufficient section modulus to carry the loading. Moreover, mounting of floor 34 by spot welds to cabinet side wall flanges 36 and 38 eliminates the need for holes and screws and provides a reliable, service-free cabinet floor mount. Mounting of a single front roller 92 in floor 34 replaces two previous rollers each mounted in associated bracket assemblies attached to the prior unit floor top plate. In addition to the previously described operation of roller 92 as a drawer positioner, the relocation of roller 92 more closely adjacent the front edge of floor 34 maintains the desired minimum horizontal spacing between front roller 92 and the rear drawer rollers 162,164 to reduce leverage loads in the trash loading position of the drawer shown in FIG. 2. This re-location of roller 92 also contributes to the aforementioned reduction in the cabinet depth dimension since the extension-mounted rear rollers of the prior unit are now replaced by rollers 162,164 mounted more forwardly and directly into the basket sidewalls 126,128.

(c) Only two drawer tracks 100,102 are required as compared to essentially four tracks in the prior unit.

(d) Due to the mounting of the power unit via the load frame 460 directly to the cabinet sidewalls 24 and 26, front panel 40 can now be a light-weight sheet metal stamping which strengthens the cabinet structure and serves as a deodorant tray. Moreover, panel 40 provides a simplified mounting of control panel 70 and key switch 58 by eliminating a separate bracket and screws previously used to mount key switch and control panel.

(e) Cabinet 22, because of the improved power unit-to-cabinet mounting, no longer requires the front and rear power unit mounting bracket channels of the prior unit, with attendant weight and cost savings.

(f) The relocation of safety switch 62 onto panel 40 also eliminates a service problem hitherto encountered due to the multiple-piece drawer latch mechanism mounted in the door becoming worn or otherwise misadjusted with the "strike" in the cabinet and thus failing to engage the safety switch upon latching of the door to the cabinet, which thereby rendered the prior unit inoperative. In the present invention, the direct engagement of the door tabs 250,252 or pins 264 with switch arm 63 occurs merely by pushing the drawer closed. Preferably, switch arm 63 is designed to travel with pin 264 during approximately the last ¼" to ½" of drawer movement while keeping switch 62 closed so that drawer 120 can be moved or positioned a slight but safe distance open (and then halted mechanically and automatically by platen edge 412) without an unnecessary electrical interlock disabling of the power unit. This feature results in significant cost, productivity and reliability improvements.

2. Drawer Basket 124

(a) Constructing basket 124 with the side walls 126 and 128 parallel to one another and integral with bottom wall 130 enables the track clearance skirts 134 and 136 to be readily formed in manufacture, and the rear wall 132, because it is a separate piece of the basket, can be more readily formed with its integral drawer lock bulge 160, thus obviating welds and saving material relative to the prior unit.

(b) Mounting of rollers 161 and 164 directly to the drawer basket enables a shortening of the depth dimension of the cabinet, resulting in part of the afore-mentioned space and cost savings.

(c) The stop 170 and nesting concavity 172 are readily formed in basket floor 130 and, in cooperation with roller 92 and recess 94 of the cabinet floor 34, provide a greatly simplified drawer-to-cabinet roller suspension and seating.

(d) The struck-out hinge ears 182,184 also simplify and reduce the cost of the basket-door hinging structure by eliminating the large hinge pins and the four large hinge-leaves which were welded to both the basket and door in the prior unit.

(e) The drawer lock bulge 160 cooperates with platen 304 as described previously to provide a fail-safe, automatic retention of drawer 120 in the cabinet when the power unit is in any position other than essentially fully retracted. In addition, this feature eliminates the need for a manually operated multiple-piece latch, hook, spring and catch mechanism mounted on the drawer and cabinet of the prior unit. Deletion of the prior latch mechanism also enables the use of a one-piece door 200 versus the multi-piece door of the prior unit.

(f) The relocation of the drawer safety interlock switch 62 onto the ledge 64 interiorly of front panel 40 provides a more protected and less operator-accessible location for this switch than in the prior unit. Moreover, the wiring leads associated with switch 62 are thereby shortened and confined to the protected upper region of the cabinet interior. This relocation, along with the deletion of the entire latch mechanism, also eliminates the need for a protective housing, mounting structure, associated wire channel cover and two separate shields required by the drawer interlock safety switch mechanism of the prior unit, with attendant large cost savings.

(g) The drawer lock bulge 160 is also advantageous in that it automatically performs an additional function of the prior drawer-to-cabinet latching mechanism, i.e., it insures that the drawer cannot be forced open by an improper refuse load during the compacting stroke. In the prior unit, a manual drawer-to-cabinet latch is required to restrain opening movement of the drawer should such improper loading condition occur.

(h) Deletion of the prior drawer-to-cabinet latch made possible by the drawer lock bulge 160, also eliminates the aggravation to the operator of attempting to operate the compactor by turning on the key switch 58 and having the compactor fail to operate because of the normal human behavior of forgetting to first manually close the combined drawer/cabinet latch and electrical interlock present in the prior unit. Since the electrical safety interlock operation is obtained automatically in the present unit merely by pushing the drawer to closed position, there is no need for the operator to remember to also close the drawer latch to enable operation of the unit by the key switch. Moreover, certain models of both the prior and present units are equipped with a foot-operated, drawer-opening treadle mechanism to thereby provide "hands-free" opening of the drawer to permit "both hands-full" deposit of trash therein. The natural inclination of the operator not to wait around for completion of the one minute cycle time in order to reopen the drawer-safety interlock latch mechanism defeats true "hands-free" operation because operation of the foot pedal will not open the drawer until the latch is released. With the present invention, when likewise equipped with such a foot treadle, no such problem can occur since the manual method of drawer latching is replaced, with an automatic method, again resulting in further improvements in cost, weight and reliability.

3. Drawer Door (a) The single piece door panel 200 replaces a multiple-piece hollow box-type door construction of the prior unit.

(b) Tabs 250,252 or pins 264, in cooperation with the socket structure 66,68,266 in front panel 40, replace a separate formed strap previously riveted to the door liner of the prior unit and provide a stronger and less resilient drawer-to-cabinet engagement, at less cost and weight.

(c) The various side edge tabs of door panel 200 provide a more economical bracing arrangement of the basket side walls 126 and 128, simplified door hinging and latching, as well as providing a mounting for the trim 204.

(d) The trim and handle pieces 202,204,206 and 208 not only service their previous functions but also cover the die-struck tab voids on door panel 200 so that the simplified drawer-door sub-assembly retains a smooth and neat exterior appearance.

(e) The tab 216 of the door panel replaces a separate welded-on latch catch of the prior unit, thereby reducing material and manufacturing costs.

(f) The opposite inclination of tab 220 relative to tabs 214,218 and 222 provides a simplified door-to-basket alignment and bracing structure and a stronger and more precise drawer assembly 120 in the latched condition of the door.

(h) Tab 210 provides a simplified engagement of the door to drawer basket for preventing relative vertical motion therebetween and insuring proper vertical alignment of these parts. Tab 210, together with tabs 214–222 replace a separate alignment part which was welded to the basket sidewall in the prior unit, with attendant cost savings.

4. Power Unit Motor and Drive Train (a) The inversion of the power unit and linkage assembly, whereby motor 302 is disposed beneath lead screw 300, cooperates with the improved mounting and suspension of the compacting mechanism of the present invention by utilizing the inherent strength of the heavy steel platen, and obviates the need for both the large, heavy structural rails extending longitudinally of the cabinet and the associated large heavy rail support brackets previously welded into the ends of the cabinet to which the rails were bolted.

(b) The improved gear and chain drive mechanism of the present invention provides a simplified structure relative to the drive of the prior unit due to the use of the much smaller single plate 330 with the U-bracket 352, thereby eliminating a plate, several spacers, a shim and rivets. Also, mounting the gear 346 and small sprocket unit 352 between the motor pinion 344 and acme screw 300 shortens the chain 362, and the mounting of switch bracket 334 with the same self-tapering bolts 332 used to mount plate 330 likewise saves on structure and cost.

(c) By mounting motor 302 on the relatively long studs 340, sufficient torsional flexibility is obtained between motor 302 and plate 330 to absorb the shock loads imposed when the rear trunnion 370 of the present invention abuts the front trunnion 314 at the fully extended position of the linkage and lowermost position of the platen 304. In the present unit, such engagement is allowed to occur and the resultant increased load on motor 302 is utilized to slow the motor and thereby cause operation of the centrifugal reversing switch mechanism of the motor to thus effect motor reversal and upward motion of the platen. Thus, the ability of the present drive train and motor mounting to absorb this shock loading enables elimination of the motor reversing limit switch structure and associated hardware and wiring of the prior unit, resulting in further improvements in cost and reliability.

(d) The improved rear trunnion 370, because it is a one-piece stamped, blanked and bent part, eliminates several of the parts employed in the "floating nut" rear trunnion as disclosed in the aforementioned Wolbrink et al patent, thereby simplifying the design and reducing service and part costs.

5. Power Unit Platen (a) Platen assembly 304, in addition to cooperating with drawer bulge 160 to provide an automatic drawer lock, essentially comprises a one-piece die-formed part instead of a multiple-piece platen and reinforcement channel assembly as in the prior unit. Reinforcement is obtained economically through the use of ribs 402 and weldment of struts 414–420 to the sides and bottoms of the platen assembly 304. Since the platen sidewalls in the present unit become much higher and are designed with an outward flange, small particles which in the prior unit could get past the platen wall and lodge on top of the platen are prevented from doing so in the present unit. This means the platen does not have to be removable, which in turn helps eliminate the cost and complexity of a heavy steel channel and several attachment parts of the prior unit, with significant cost, weight, service and maintenance improvements.

(b) The overlapping relationship of the platen side and end walls and the inherent strength of this box-like structure, as well as the relatively heavy gauge of the steel employed therein, provides a secure mount for the spacer struts 414–420 to receive the associated links 426, 430, 434 and 436 pivotally connected thereto. Hence the lower end of the linkage assembly is securely retained and braced against lateral spreading and twisting forces imposed on the toggle linkage during its compacting stroke, and yet adequate space and clearance is provided for relative movement of motor 302 into the space between the struts in the collapsed, retracted condition of the compacting mechanism.

6. Power Unit Load Frame (a) Due to the inversion of the motor, lead screw and toggle linkage mechanism of the present invention relative to that shown in the aforementioned prior unit and Moon patents, the motor does not have to travel past the upper pivot points 462 and 464. Hence, the load frame assembly 460 can contain the uninterrupted cross shafts 462 and 464 as well as beams 470 and 472 in a rectangular box-frame type structure having a high strength-to-weight ratio. This in turn reduces cost by enabling the use of much smaller and less expensive framework components.

(b) Load frame 460 also is simplified because of the shorter span between the connection points of the upper links 448,450,454,456 to shafts 462 and 464 and the load bearing connection of the links to the cabinet side walls through the shafts and/or the beams and brackets 474 and 476. This shorter span is a function of the reduced width dimension of cabinet 22 as compared to the prior unit. Reduced cabinet width in turn is obtained from placement of roller 92, the folded-back cabinet reinforcement flanges 37 and 39, the use of parallel basket walls 126 and 128 compared to the compound, inverted taper configuration of the basket in the prior unit, the use of narrower, flat, reverse bent and folded upper flanges 127 and 129 on basket 124, a thinner basket toggle-latch part 176, and elimination of a U-shaped doubled-back bend on the front basket edges of the prior unit. Elimination of the top-to-bottom and rear-to-front tapers of the prior basket also make tooling and manufacturing simpler and lower-cost.

(c) The simplication of load frame assembly 460 in accordance with the present invention also results in large measure from the mounting of the load frame laterally direct to the tension load bearing cabinet side walls 24 and 26 in as close proximity as possible to the upper ends of the compacting linkage. By thus shortening the load bearing moment arms in the framework between linkage and cabinet walls, a much simpler and more cost and weight efficient load frame structure has been provided pursuant to the present invention.

From the foregoing description, it now will be apparent that the present invention provides an improved refuse compactor with many new and useful features which amply fulfill the objects of the present invention.

MODIFIED EMBODIMENTS OF FIGS. 16–21

Platen Assembly

Figure 16:
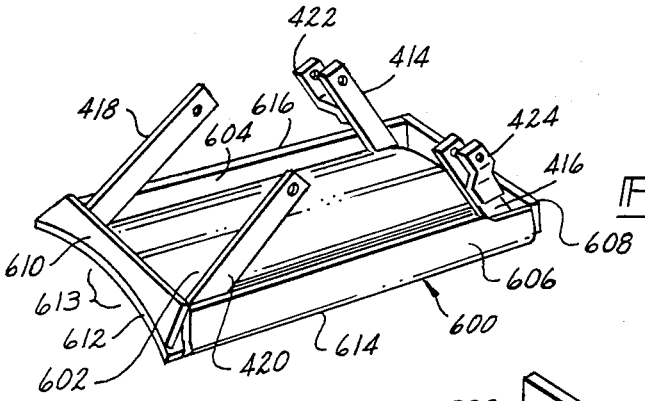
FIG. 16 is a perspective view of a modified embodiment of a platen sub-assembly of the present invention.

Referring to FIG. 16, a modified embodiment 600 of the previously described platen assembly 304 is illustrated as a separate sub-assembly and having the same outside dimensions as platen assembly 304. Platen 600 is shown turned around 180° from the position of platen 304, as viewed in FIG. 8, but in generally the same relationship as viewed in FIG. 10, and incorporates the same struts as 414, 416, 418 and 420 and clevice brackets 422 and 424 as employed in platen 304.

In lieu of the flat bottom wall 400 with the reinforcing ribs 402 formed therein, platen 600 is formed with a modified bottom wall 602 having a part cylindrical shape so as to be curved upwardly about an axis of curvature extending fore and after of the compactor 20, i.e., parallel to the lengthwise dimension of the compactor. Preferably, the radius of curvature of the bottom wall 602 is constant and in one preferred embodiment wherein the outside width dimension of platen 600 is 7–12", the center of bottom wall 602 is spaced vertically above the plane of the outside side edges of wall 602 by approximately ¾". As in platen 304, the side edges of bottom wall 602 are integrally joined to side wall 604 and 606 which are bent upwardly from bottom wall 602 and taper inwardly at a slight angle toward one another. The front end wall 608, like wall 408, extends upwardly perpendicularly to the bottom wall 602 and its inner face at the ends thereof laps against and is welded to the end edges of side walls 604 and 606. However, front end wall 608 and the rear end wall 610, unlike end walls 408 and 410, are separate pieces having their lower edges contoured to seat upon the curved upper face of bottom wall 602 and are welded thereto along this joint. Rear end wall 610 is inclined inwardly and upwardly from bottom wall 602 and abuts the end edges of side walls 604 and 606 and is also welded at these abutments to the side wall. In place of the large radius curvature of junction 412 of platen 304, platen 600 is provided with a smooth curvature of relatively large radius and smooth surface by imparting such curvature to the lower corner of the rear end edge 612 of bottom wall 602 in the zone indicated at 613 in FIG. 16 to thereby likewise minimize the danger of snagging the trash bag in the event of rubbing contact between edge 612, the bag and the apex of basket wall bulge 160.

By providing the bottom wall 602 as a part cylindrical shape so that its bottom face is concave as presented to the trash or refuse being compacted, bottom wall 602 embodies a hoop strength characteristic and is placed into tensile stress mode rather than a bending mode during compacting action. Since steel is much stronger in tension than it is in bending, an improved strength-to-weight ratio is obtained along with several additional advantages of platen 600 relative to platen 304, which may be enumerated as follows:

1. The need for a series of formed stiffening ribs 402 is eliminated, along with the expense of a large manufacturing die set and press machine (in the case of high production volume) or a less expensive smaller die set to form one or two ribs per stroke combined with labor-intensive, multiple press strokes in the case of lower production rates.

2. The possibility of toublesome distortion which could occur from what could be considered a fairly severe metal "drawing" operation to form ribs 402 is eliminated entirely.

3. The proven advantage of an "irregular", i.e., upwardly curved wall 602 providing a concave bottom face, rather than the flat surface of wall 400, which provides pressure concentration points in the breaking of glass containers, means that more glass bottles, jugs, and jars will be compressed, thus increasing substantially the total amount of trash the machine can store before a person must open it, remove the full bag to the storage area, install a new bag and reclose the unit: a significant advantage in today's world where everyone craves more free time.

4. Again, in support of the principle of better compaction, greater capacity, and longer intervals between emptying, the cylindrical curvature of bottom wall 602 is much more rigid than a flat one, thus increasing the overall performance of the trash compactor assembly for the customer.

5. Another advantage of the curved platen wall 602 is that it enables the use of thinner metal, producing further cost, weight and manufacturing savings.

6. Similar to a snow shovel or snow plow or a bulldozer blade, the protective action of the scoop-shaped longitudinal edges 614 and 616 of the compacting surface of wall 602 help to move sharp fragments away from the sides of the compacting chamber where such fragments occasionally cut or tear even the strongest of compactor bags. Thus, the user sees fewer of the harmless, but unsightly holes which sometimes trouble the compactors now on the market.

7. Skirt 442 (shown in phantom in FIG. 10) represents added piece parts to manufacture, assemble, stock, and possibly to service. Curved surface platen 600 allows the use of thinner steel and thereby eliminates any possible need for these parts and costs because the lower cost of thinner platen stock makes feasible the use of higher sides and end-plates for the primary platen bottom and sidewall components themselves. Thus, side walls 604 and 606 and end walls 608 and 610 may be extended upwardly a distance equal to the upper edge of the skirt 442 so as to additionally perform the function of skirt 442. Thus, the platen itself provides any functions performed by the possible use of skirts.

GEAR BOX ASSEMBLY

Figure 17:
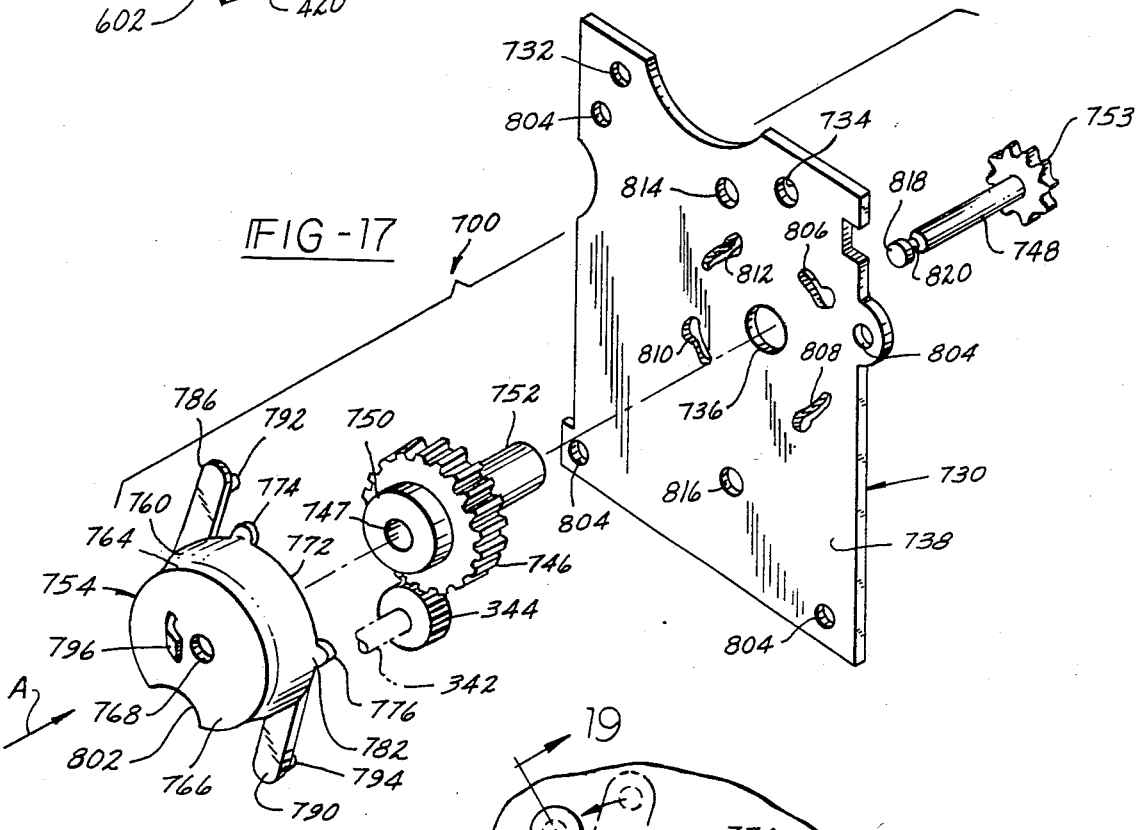
FIG. 17 is an exploded perspective view of a modified embodiment of an improved gear box sub-assembly for the gear-sprocket-chain drive train of the present invention.
Figure 18:
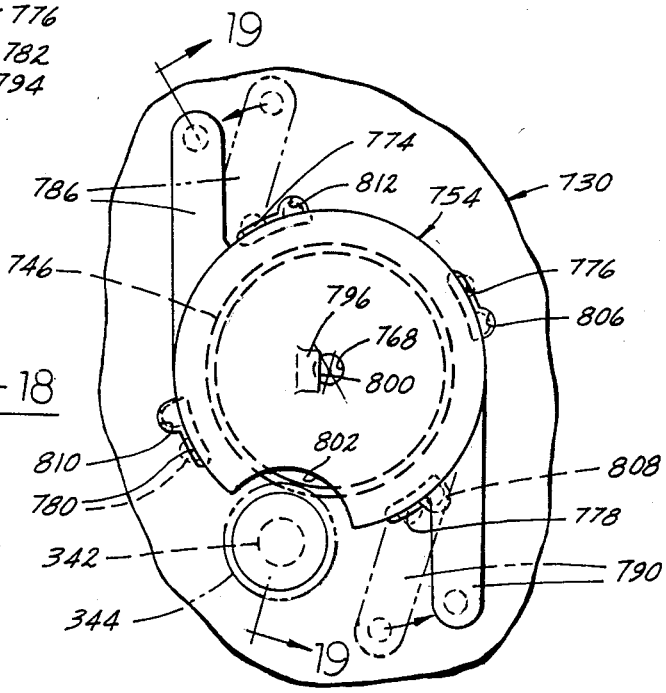
FIG. 18 is a fragmentary vertical elevational view of the sub-assembly of FIG. 17 as viewed in looking in the direction of arrow A in FIG. 17.
Figure 19:
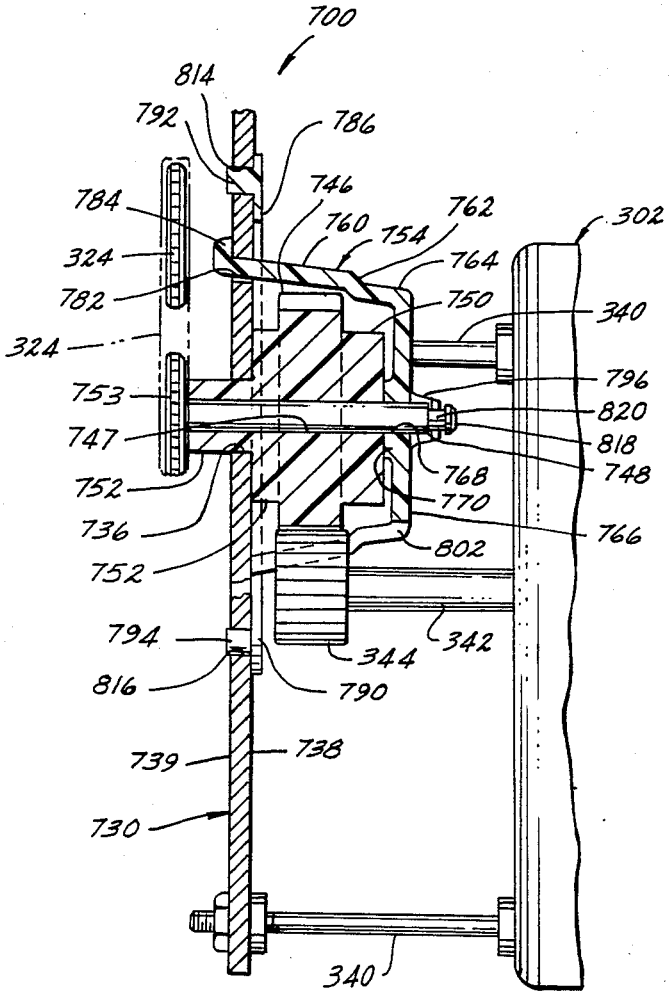
FIG. 19 is a vertical sectional view taken along line 19—19 of FIG. 18.

Referring to FIGS. 17–19, a modified embodiment of the gear box assembly 700 is shown in which a modified support plate 730, shaft 748 and the associated chain sprocket 753, gear 746 and associated integral bushing-thrust washers 750 and 752 and bracket cup 754 are substituted for the corresponding parts 330, 348, 353, 346, 350, 352 and 354 of the previously described gear box assembly of FIG. 11. Plate 730 is mounted in the same manner as plate 330 to the bearing block 314 by bolts 332 inserted through holes 732 and 734. Pinion gear 746 is injection molded of suitable plastic material and the thrust washer portion 750 and combined thrust washer and bushing portion 752 are integrally molded therewith. Bushing 752 is inserted with a close-fitting journal fit through a cylindrical hole 736 in plate 730 (FIG. 19) until a diametrically enlarged thrust washer portion 752' of portion 752 has its end face in abutment with the associated surface 738 of plate 730. Sprocket shaft 748 is inserted through the central through bore 747 of the gear and bushing part 746–752 and is keyed thereto for rotation therewith by suitable key means (not shown). The plate hole 736 is provided with a smooth hard finish so that plastic bushing 752 provides its own bearing in the steel plate 730.

Bracket cup 754 replaces bracket 354, push-on retainer 360 and the bushing portion of part 350 of the embodiment of FIG. 11 and comprises a one-piece plastic part, preferably an injection molded thermoplastic part, having a cup-shaped portion made up of a frusto-conical wall 760 which is necked down at 762 to merge with a smaller diameter frusto-conical wall 764 which in turn is jointed to a flat end wall 766. A shaft journalling hole 768 extends centrally through wall 766 and the length of this journal hole is extended by a bushing and thrust projection 770 molded integrally with the interior cup wall 766.

The free edge 772 is adapted for flat abutment against face 738 of plate 730 and a plurality of locking tabs 774, 776, 778 and 780 are provided at equally spaced intervals around the circumference of edge 772. As best seen in FIGS. 17 and 19, each tab 774–780 has a leg portion 782 extending outwardly from edge 772 as an extension of cup side wall 760 by a distance about twice the thickness of plate 730, and a radially outwardly extending ear portion 784 adapted to abut the face 739 of plate 730 when assembled thereto.

Bracket cup 754 also has one or more (herein shown as two) thin, flexible leaf arms 786 and 790 (FIGS. 17, 18 and 19) which are integrally joined at their inner ends to cup wall 760 at diametrically opposite locations and extend tangentially outwardly to free ends spaced radially outwardly of cup wall 760. Each leaf arm carries an integral locking pin 792 and 794 respectively of cylindrical shape which projects axially of bracket cup 754 towards plate surface 738.

Bracket cup 754 also has a flexible locking tang 796 (FIGS. 17, 18 and 19) integrally joined to end face 766 and protruding outwardly therefrom. Tang 796 is flexible and curves toward the axis of hole 768 and terminates in a locking edge 800 disposed slightly within the axial phantom projection of the bore wall of hole 768, as best seen in FIG. 18. Cup wall 76 and a portion of cup side wall 764 and 760 are cut away to provide a circumferential notch at 802 to provide assembly clearance with the motor drive shaft pinion 344. Referring again to support plate 730, the same is provided with the four mounting holes 804 which receive the four motor mounting studs or pins 340 to support motor 302 in the same manner as plate 330. In addition, plate 730 has four modified key hole shaped openings 806, 808, 810 and 812 at equally angularly spaced intervals around bearing hole 736, the enlarged portions of which are adapted to receive locking tabs 774, 776, 778 and 780 respectively therethrough, with the narrow extensions of key holes 806–812 being adapted to pass only the leg portions 782 of the associated locking tabs therethrough. Plate 730 also has two cylindrical through holes 814 and 816 adapted to receive with a close fit the locking pins 792 and 794 respectively.

Once the gear and bushing part 746–752 has been assembled to plate 730, the sprocket 753 and shaft 748 assembly is inserted through bore 747 to its position as shown in FIG. 19. Bracket cup 754 is then assembled to these parts and to plate 730 by moving cup 754 axially toward plate 730 so that ears of the locking tabs 774–780 project through the enlargements of the associated key holes 806–812 as edge 772 is brought into abutment with face 738. In this condition, locking pins 792 and 794 will be abutting face 738 and leafs 786 and 790 will be thus flexed backwardly away from face 738 while yieldably urging pins 792 and 794 against face 738. Cup 754 is then rotated clockwise as viewed in FIG. 17 for approximately 15° to 20°, thereby allowing pins 792 and 794 to drop into locating holes 814 and 816 respectively, thus locking cup 754 against rotation relative to plate 730. Likewise, the ears 784 of locking tabs 774–780 will be moved along the narrow portions of the keyholes 806–812 to the solid line portions thereof shown in FIG. 18, thereby holding cup 754 locked tightly to plate 730 against axial movement relative thereto.

As cup 754 is assembled as described above to plate 730, the free end 818 of shaft 748 will pass through bore 768 and engage and flex outwardly tab 796 until reaching final assembled position of cup 754 on plate 730, at which point the free edge of tab 796 will snap into a groove 820 of shaft 748, thereby locking shaft 748 against movement axially to the left as viewed in FIG. 19.

Motor 302 may then be mounted to plate 730 by the four mounting studs 340, the notched out portion 802 of cup 754 permitting endwise insertion of pinion 344 into engagement with gear 746, as shown in FIG. 19. Then the motor and gear drive sub-assembly may be mounted to bearing block 314 by bolts 332.

Figure 20:
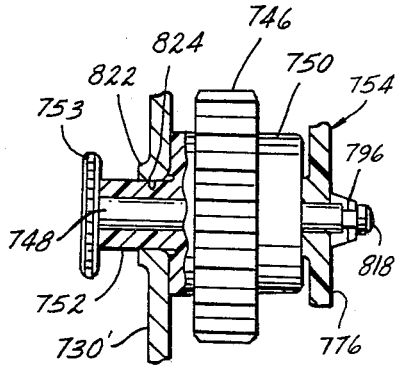
FIG. 20 is an elevational fragmentary view, taken partially in vertical center section, of a modified mounting plate for use in the gear box assembly of FIGS. 17–19 also in accordance with the present invention.

Referring to the further modified mounting plate 730′ shown in FIG. 20, if plate 730 is not deemed thick enough to provide adequate bearing surface area in bore hole 736, then the bearing bore surface area can be multiplied several-fold by slightly extruding the material of plate 730′ to provide an extruded boss portion 822. The extended bore wall 824 is then provided with the bearing-quality surface finish and controlled dimensional fit with bushing portion 752 similar to bore 736 for journalling part 746–752 in plate 730′.

Figure 21:
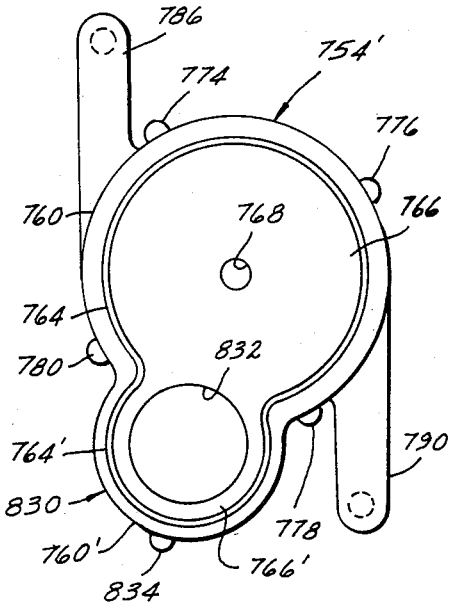
FIG. 21 is a vertical elevational view of a modified embodiment of the combined mounting bracket-bushing and thrust retainer part for use in the gear box sub-assembly of FIGS. 17–19.

Referring to the further modified embodiment of the combined mounting bracket-bushing and thrust retainer cup 754′ shown in FIG. 21, the same is constructed similar to cup 754 except for elimination of notch 802 and the addition of part cylindrical integral housing portion 830. Portion 830 is sized to encase, with a clearance, pinion 344 and has part cylindrical extension 760′ and 764′ of the cup walls 760 and 764 respectively. The end wall 766′ of portion 830 is an extension of wall 766 and is provided with a cylindrical opening 832 adapted to receive pinion 344 axially therethrough. An additional locking tab projection 834, similar to tabs 774–780, may be provided on portion 830 and a corresponding additional keyhole (not shown) provided in plate 730 for receiving the same. The modified bearing and retainer cup 754′ thus constitutes a strengthened retainer and bushing support, thereby providing a stiffer mounting for shaft 748 and stronger attachment of the bearing cup 754′ to plate 730. The housing extension portion 830 also provides a complete enclosure for pinion 344, and thus cup 754′ completely encloses and shields the gear set 344 and 746 from dust or other foreign objects, as well as serving a guard for the gear train.

In addition to the advantages set forth previously, the modified gear box assembly of FIGS. 17–21 comprises fewer parts and offers reduced material, manufacturing and assembly costs, as compared to the gear box assembly of FIG. 11. It should be noted that the loading by chain 324 on sprocket 753 which imparts an upward and clockwise bending moment on shaft 748, as viewed in FIG. 19, is balanced by the opposite bending moment imparted by the gear separation force of pinion 344 exerted on gear 746, which in turn reduces the stress load on cups 754 or 754′. The gear box is readily disassembled for servicing by first bending tang 796 out of shaft groove 820 and then reversing the previously described assembly steps. The dies, tooling and labor required for manufacture of bracket 354, as well as the welding fixtures and welding labor required to attach bracket 354 to plate 330, is also eliminated. Any welding distortion problems are also eliminated. The separate bushing parts 350 and 352 and retainer 360 are also eliminated. Thus, in addition to the direct cost and labor savings of replacing five separate parts with two, improvements in reliability and reductions in warranty costs are also obtained by the improved gear box assembly of FIGS. 17–21.

I claim:

1. In a refuse compactor of the type having a rectangular box-like cabinet made up of a pair of parallel upright side walls, a horizontal top wall connected to the side walls, a removable upright rear wall connected to the rear edges of the top and side walls and a horizontal bottom wall connected to and extending between the bottom edges of said side walls, a unitary trash basket and drawer having upright side walls, a rear wall, a hinged front door and a bottom wall, said drawer being removably received via an access opening in the front of the cabinet and horizontally movable between a fully inserted trash compacting position within the cabinet wherein said drawer bottom wall seats on said cabinet bottom wall and movable outwardly therefrom to trash loading and unloading positions, and a refuse compacting mechanism mounted in the upper interior region of the cabinet and having a platen movable between a retracted position above the drawer and extended position disposed within the drawer when the latter is in its compacting position, said side walls each being provided with an inturned flange along the lower horizontal edge thereof, and said cabinet bottom wall comprises a single sheet of relatively heavy thickness steel securely fastened onto said side wall flanges.

2. The refuse compactor as set forth in claim 1 wherein said cabinet is provided with a one-piece front panel connected to the front edges of said side walls and extending above the front access opening, said front panel having a channel section formed in the lower portion thereof adapted to hold deodorant materials.

3. The refuse compactor as set forth in claim 2 further including a pair of rollers adjacent mounted on said drawer in laterally spaced relation directly the rear of the drawer, and a pair of drawer guide tracks individually secured one to each of the interior surfaces of the side walls for individually receiving said drawer rollers in tracking relation therealong.

4. The refuse compactor as set forth in claim 3 wherein said side walls each having a flange extending along the vertical front edge thereof, the upper portion of each said flange being bent at right angles to the side wall and overlapping said cabinet front panel and secured thereto, each said side wall flange below said upper portion being bent back upon itself flush against the adjacent interior surface of the associated side wall to maximize the width of said access opening.

5. The refuse compactor as set forth in claim 3 wherein a single roller is rotatably journalled in and centrally of said bottom wall adjacent the front edge thereof for roller supporting engagement with said bottom wall of said drawer.

6. The refuse compactor as set forth in claim 2 including a control panel made of molded plastic with integral snap-in attachment finger means adapted for removable engagement with cooperating aperture means in said cabinet front panel, said front panel having an outwardly and upwardly inclined lip adjacent its upper edge and said control panel having a cooperating dependent lip for overlapping engagement with said front panel lip to permit hook-on pivotal attachment of said control panel at an outwardly and downwardly inclined attitude and permitting swinging movement of said control panel inwardly toward said front panel to bring said attachment finger means into fastening engagement with said aperture means.

7. In a refuse compactor of the type having a rectangular box-like cabinet made up of a pair of parallel upright side walls, a horizontal top wall connected to the side walls, a removable upright rear wall connected to the rear edges of the top and side walls and a horizontal bottom wall connected to and extending between the bottom edges of said side walls, a trash basket drawer having upright side walls, a rear wall, a hinged front door and a bottom wall, said drawer being removably received via an access opening in the front of the cabinet and horizontally movable between a fully inserted trash compacting position within the cabinet wherein said drawer bottom wall seats on said cabinet bottom wall and movable outwardly therefrom to trash loading and unloading positions, and a refuse compacting mechansim mounted in the upper interior region of the cabinet and having a platen movable between a retracted position above the drawer and extended position disposed within the drawer when the latter is in its compacting position, the improvement wherein said rear wall of said drawer has contoured means provided along the interior surface thereof defining a vertically extending surface disposed parallel to and spaced slightly rearwardly of the path of travel of said platen during movement of said platen within said drawer to and from said extended position whereby said platen blocks horizontal movement of said drawer from its compacting position toward its trash unloading position while said platen is within said drawer.

8. The refuse compactor as set forth in claim 7 further including a pair of rollers mounted on said drawer in laterally spaced relation adjacent the rear of said drawer, a pair of drawer guide tracks formed as channel sections individually secured one to each of the interior surfaces of the side walls for individually receiving said drawer rollers in tracking relation therealong, and a roller rotatably journalled in said bottom wall adjacent the front edge thereof for roller supporting engagement with said drawer bottom wall, and wherein said drawer bottom wall has a concavity adapted to register with said cabinet bottom wall roller when said drawer is in said compacting position, said guide tracks having inclined ramps also registering with said drawer rollers in the compacting position of said drawer, such registry of said rollers permitting said drawer to drop into said seated engagement with said cabinet bottom wall.

9. The refuse compactor as set forth in claim 8 wherein said drawer bottom wall has an integrally formed downward projection and said cabinet bottom wall has a concavity in which said drawer bottom wall projection nests in said seated compacting position of said drawer, said drawer bottom wall projection being disposed near the rear of the drawer and adapted to abut said cabinet bottom wall roller in the trash loading position of said drawer to thereby serve as a positioning stop for said drawer.

10. The refuse compactor as set forth in claim 8 wherein said drawer side walls have outwardly and downwardly tapered skirt portions along the lower edges of said side walls connected to said drawer bottom wall, the junction of said skirts and bottom wall having a close sliding clearance with the associated adjacent cabinet side walls with said drawer side wall skirts flaring outwardly beneath the associated guide track.

11. The refuse compactor as set forth in claim 10 wherein said drawer side walls and bottom wall are integrally formed from one piece of sheet metal, said drawer rear wall being formed as a separate piece with side edge flanges overlapping and secured to the rear edges of said drawer side wall, the upper edges of said drawer side walls and said rear wall being bent outwardly into stiffening flanges, said side wall flanges being doubled under and flattened, said drawer side walls above the associated skirt portions thereof being disposed in parallel upright relation to one another.

12. The refuse compactor as set forth in claim 7 wherein the front edge of one of said drawer side walls has a pair of vertically spaced, integral, lanced tabs protruding outwardly therefrom to serve as hinge leaves for hinge mounting of said drawer front door on said drawer.

13. In a refuse compactor of the type having a rectangular box-like cabinet made up of a pair of parallel upright side walls, a horizontal top wall connected to the side walls, a removable upright rear wall connected to the rear edges of the top and side walls and a horizontal bottom wall connected to and extending between the bottom edges of said side walls, a trash basket drawer having upright side walls, a rear wall, a bottom wall and a front door hinged to one of said drawer side walls for swinging movement on an upright axis between open and closed positions, said drawer being removably received via an access opening in the front of the cabinet and horizontally movable between a fully inserted trash compacting position within the cabinet wherein said drawer bottom wall seats on said cabinet bottom wall and movable outwardly therefrom to trash loading and unloading positions, and a refuse compacting mechanism mouhted in the upper interior region of the cabinet and having a platen movable between a retracted position above the drawer and extended position disposed within the drawer when the latter is in its compacting position, the improvement wherein said drawer door comprises a single piece of sheet metal having a series of inwardly extending tabs struck from each vertical side edge of said door and overlappingly engaging the associated drawer side wall in the closed position of said door to thereby horizontally align said drawer door with said drawer side walls.

14. The refuse compactor as set forth in claim 13 wherein the free vertical side edge of said door remote from the hinged vertical side edge of said door has at least one of said tabs oriented to overlap the interior surface of the associated drawer side wall and a majority of said tabs along said remote side edge of said door are oriented to overlap the exterior surface of said associated door side wall in the closed position of said door.

15. The refuse compactor as set forth in claim 13 wherein the lower corner of said door remote from the hinged side edge thereof has a tab bent inwardly therefrom adapted to engage the front edge of said drawer bottom wall to thereby vertically align said door with said drawer in the closed position of said door.

16. The refuse compactor as set forth in claim 15 wherein said door edge tabs along the hinged side edge of said door are oriented to lap closely against the exterior surface of the associated drawer side wall in the closed position of said door.

17. The refuse compactor as set forth in claim 16 wherein said hinge side edge of said door also includes a pair of struck-out hinge ears vertically spaced apart along said hinge side edge of the door and pivotally connected by hinge pins to associated hinge tabs struck out from the associated drawer side wall.

18. The refuse compactor as set forth in claim 17 wherein said door has a pair of alignment guides projecting from an upper portion of said door towards said drawer and disposed thereabove, and said cabinet has a front panel extending above the front access opening, said front panel having aperture means adapted to receive said drawer door guides in the closed position of said door when said drawer is moved to its compacting position in said cabinet.

19. The refuse compactor as set forth in claim 18 wherein said doorguides comprise a pair of cylindrical pins and said cabinet front panel aperture means comprise vertically elongated slots adapted to individually receive said pins with a close sliding fit laterally yet with sufficient vertical clearance to allow vertical movement of said pin in said slot as said drawer moves through its last increment of travel into the seated compacting position of said drawer in said cabinet.

20. The refuse compactor as set forth in claim 19 wherein one of said door guides is adapted to protrude interiorly of said cabinet front panel in the seated position of said drawer, said cabinet having an electrical safety switch interlock means mounted interiorly thereof with a switch arm adapted to be engaged by said one door guide during said last increment of drawer travel to its seated position.

21. The refuse compactor as set forth in claim 20 wherein said door has notches along each door side edge formed by striking and bending of said inwardly extending tabs and said door has a decorative trim strip affixed to the exterior surface therein overlying in covering and concealing relation to said notches.

22. In a refuse compactor of the type having a rectangular box-like cabinet including a pair of parallel upright side walls, a horizontal top wall connected to the side walls, and a horizontal bottom wall connected to and extending between said side walls, a trash basket drawer having upright side walls, a rear wall, a hinged front door and a bottom wall, said drawer being removably received via an access opening in the front of the cabinet and horizontally movable between a fully inserted trash compacting position within the cabinet wherein said drawer bottom wall seats on said cabinet bottom wall and movable outwardly therefrom to trash loading and unloading positions, and a refuse compacting mechanism mounted in the upper interior region of the cabinet and having a platen movable between a retracted position above the drawer and extended position disposed within the drawer when the latter is in its compacting position, said refuse compacting mechanism comprising an extensible toggle linkage means having first connector means operably coupled to said cabinet, second connector means operably connected to said platen and movable therewith, and third connector means intermediate said first and second connector means and comprising first and second spaced pivot means movable relative to one another transversely of the direction of movement of said platen to extend and retract said linkage means, and a motor mounted on and carried by said toggle linkage means for bodily movement therewith, said toggle linkage means including force transmitting means operably coupling said motor with said toggle linkage means for causing said relative movement of said spaced pivot means to thereby move said platen between said extended and retracted positions thereof, said force transmitting means comprising a threaded shaft and nut rotatable relative to one another by said motor and mounted to said third connector means for bodily movement with said toggle linkage means, the improvement wherein said motor is disposed beneath said threaded shaft between said shaft and said platen.

23. The refuse compactor as set forth in claim 22 wherein said nut has opposing faces through which said threaded shaft extends and a housing surrounding said nut for restraining said nut from rotation with the lead screw, said housing having a pair of walls lying generally normal to said lead screw and loosely embracing said nut along said faces for permitting relative pivotal movement of said nut with respect to said housing about an axis generally normal to the lead screw, the faces of said nut having corners which abut said walls during said relative movement, said housing being coupled to first pivot means, said housing being formed of a single piece of sheet metal folded into a U-shape with a tab closing the open end of the U-shape, said tab and the bight wall of the housing forming said pair of walls, said sheet metal piece having mutually overlapping bent ears on opposite sides of said threaded shaft and receiving fasteners therethrough to provide said coupling of said housing to said first pivot means.

24. In a refuse compactor comprising a framework, a receptacle removably received in said framework adjacent one end of said framework and having an open end facing the end of the framework opposite said one end, a compacting mechanism mounted in said framework adjacent said opposite end thereof including a presser platen movable into and out of the open end of said receptacle between extended and retracted positions thereof, said mechanism comprising an extensible toggle linkage means having first connector means operably connected to said framework, second connector means operably connected to said platen and movable therewith, and third connector means intermediate said first and second connector means and comprising first and second spaced pivot means movable relative to one another transversely of the direction of movement of said platen to extend and retract said linkage means, and a motor mounted on and carried by said toggle linkage means for bodily movement therewith, said toggle linkage means including force transmitting means operably coupling said motor with said toggle linkage means for causing said relative movement of said spaced pivot means to thereby move said platen between said extended and retracted positions thereof, said force transmitting means comprising a threaded shaft and nut rotatable relative to one another by said motor and mounted for bodily movement with said toggle linkage means, the improvement wherein said motor is disposed beneath said threaded shaft and between said shaft and said platen.

25. The refuse compactor as set forth in claim 24 wherein said shaft coupling means comprises a trunnion block in which said shaft is journalled for rotation, a flat motor mounting plate secured at its upper end to said block and extending downwardly therebelow, said motor being mounted to said plate in cantilever fashion by a series of relatively long studs, said studs and the motor armature shaft being oriented parallel to said shaft, said studs protruding from the space between the motor and said plate, and having limited flexibility to absorb motor-linkage reaction torsional forces, and a force multiplying, drive train coupling said motor armature shaft to the said threaded shaft.

26. The refuse compactor as set forth in claim 25 wherein said drive train means includes a drive pinion on said motor armature shaft, a larger driven pinion meshing said motor drive pinion, said larger pinion being journalled and keyed on a stub shaft, said stub shaft being journalled in a pair of plastic bushings, one of said bushings having a sleeve portion protruding through said plate and the other of said bushings having a sleeve portion extending toward said motor, said stub shaft protruding at its ends beyond the ends of said bushing sleeves, a U-shaped bracket secured to said plate between said motor and said plate and supporting said sleeve of said other bushing, a drive sprocket secured on the end of said stub shaft on the side of said plate remote from said motor, a larger driven sprocket secured to a protruding end of said threaded shaft and a chain trained over said sprockets.

27. The refuse compactor as set forth in claim 26 wherein said motor includes a centrifugally actuated reversing switch, said compacting mechanism being operable in a fully extended condition thereof to cause said shaft coupling means and said nut means to come into abutment, said abutment causing said motor to slow down and effect operation of said centrifugal switch to reverse the rotation of said motor and thus initiate retraction of the plate, said motor mounting studs being operable to provide a shock absorbing mounting for said motor upon said abutment-reversal operation.

28. The refuse compactor as set forth in claim 27 further including a switch mounting plate, fastening means securing said motor-mounting plate and said switch plate in cantilever fashion to respectively extend below and above said trunnion block, switch means mounted on said switch plate above said threaded shaft and including switch arm means operable to engage the cabinet top wall at the end of the retraction stroke of said compactor mechanism to effect shutoff of said motor.

29. The refuse compactor as set forth in claim 28 wherein said motor has capacitor-start circuitry means associated therewith including a capacitor mounted on said motor at the end thereof remote from said motor mounting plate.

30. The refuse compactor as set forth in claim 22 wherein said rear wall of said drawer has contoured means provided along the interior surface thereof defining a vertically extending surface disposed parallel to and spaced slightly rearwardly of the path of travel of said platen during movement of said platen within said drawer to and from said extended position whereby said platen blocks horizontal movement of said drawer from its compacting position toward its trash unloading position while said platen is within said drawer.

31. The refuse compactor as set forth in claims 22 or 30 wherein said drawer door comprises a single piece of sheet metal having a series of inwardly extending tabs struck from each vertical side edge of said door and overlappingly engaging the associated drawer side wall in the closed position of said door to thereby horizontally align said drawer door with said drawer side walls.

32. The refuse compactor as set forth in claim 31 wherein said platen comprises a one-piece heavy-gauge sheet metal member having a flat bottom wall and a pair of side walls and a pair of end walls turned up from said bottom wall, said bottom wall having a series of corrugated reinforcing ribs formed therein and extending transversely of the longitudinal dimension of said bottom wall.

33. The refuse compactor as set forth in claim 32 wherein said first connector means comprises a pair of pivot shafts extending axially between said cabinet side walls near the upper ends thereof, a pair of rail members extending transverse to said pivot shafts and holding the same in fixed spaced relation, said compactor linkage being pivotally connected to said pivot shafts to form an immobile pivot anchorage for said linkage mechanism, and a pair of anchor bracket plates individually welded one to each of the interior surfaces of said cabinet side walls adjacent said cabinet top wall, the opposite ends of said pivot shafts being operably coupled to the associated bracket plate for transmitting refuse compacting reaction loads from said linkage to said cabinet side walls.

34. The refuse compactor as set forth in claim 33 wherein said nut has opposing faces through which said threaded shaft extends and a housing surrounding said nut for restraining said nut from rotation with the lead screw, said housing having a pair of walls lying generally normal to said lead screw and loosely embracing said nut along said faces for permitting relative pivotal movement of said nut with respect to said housing about an axis generally normal to the lead screw, the faces of said nut having corners which abut said walls during said relative movement, said housing being coupled to first pivot means, said housing being formed of a single piece of sheet metal folded into a U-shape with a tab closing the open end of the U-shape, said tab and the bight wall of the housing forming said pair of walls, said sheet metal piece having mutually overlapping bent ears on opposite sides of said threaded shaft and receiving fasteners therethrough to provide said coupling of said housing to said first pivot means.

35. In a refuse compactor of the type having a cabinet, a trash basket drawer having an open upper end and a bottom wall, said drawer being removably received via an access opening in the front of the cabinet and horizontally movable between a fully inserted trash compacting position within the cabinet and movable outwardly therefrom to trash loading and unloading positions, and a refuse compacting mechanism mounted in the upper interior region of the cabinet and having an extensible linkage, a motor drive operably coupled to said linkage for extending and retracting the same, and a platen connected to said linkage and movable between a retracted position above the drawer and extended position disposed within the drawer when the latter is in its compacting position, the improvement wherein said platen has rigid strut means pivoted to said linkage and comprises a one piece heavy-gauge sheet metal member having a flat bottom wall and a pair of side walls and a pair of end walls turned up from said bottom wall, said bottom wall having a series of corrugated reinforcing ribs formed therein and extending transversely of the longitudinal dimension of said bottom wall, the bottom face of said bottom wall being exposed to the interior of said drawer for directly contacting and compacting trash received therein.

36. The refuse compactor as set forth in claim 35 wherein said platen strut means includes four struts each secured at a lower end thereof and to an associated one of the four corners of said platen and extending upwardly therefrom, said linkage being pivotally connected to the upper ends of each of said struts.

37. The refuse compactor as set forth in claim 36 wherein said platen has an open-ended four-sided sheath secured to and encircling said side and end walls of said platen and extending thereabove to help prevent refuse from collecting on the uper surface of said platen bottom wall.

38. In a refuse compactor of the type having a rectangular box-like cabinet made up of a pair of parallel upright side walls, a horizontal top wall connected to the side walls, a rear wall connected to the rear edges of the top and side walls and a horizontal bottom wall connected to and extending between the bottom edges of said side walls, a trash basket drawer having an open upper end and a bottom wall, said drawer being removably received via an access opening in the front of the cabinet and horizontally movable between a fully inserted trash compacting position within the cabinet wherein said drawer bottom wall seats on said cabinet bottom wall and movable outwardly therefrom to trash loading and unloading positions, and a refuse compacting mechanism mounted in the upper interior region of the cabinet and having a platen movable between a retracted position above the drawer and extended position disposed within the drawer when the latter is in its compacting position, said compacting mechanism comprising an extensible toggle linkage means having first connecting means operably connected to said cabinet, second connector means operably connected to said platen and movable therewith, and third connector means intermediate said first and second connector means and comprising first and second spaced pivot means movable relative to one another transversely of the direction of movement of said platen to extend and retract said linkage means, a motor mounted on said linkage means for bodily movement therewith and screw and nut means coupling said motor with said toggle linkage means for causing relative movement of said spaced pivot means to thereby move said platen between said extended and retracted positions thereof, the improvement wherein said first connector means comprises a pair of pivot shafts extending axially between said cabinet side walls near the upper ends thereof, a pair of rail members extending transverse to said pivot shafts and holding the same in fixed spaced relation, said compactor linkage being pivotally connected to said pivot shafts to form an immobile pivot anchorage for said linkage mechanism, and a pair of anchor bracket plates individually welded one to each of the interior surfaces of said cabinet side walls adjacent said cabinet top wall, the opposite ends of said pivot shafts being operably coupled to the associated bracket plate for transmitting refuse compacting reaction loads from said linkage to said cabinet side walls.

39. The refuse compactor as set forth in claim 38 wherein said first connector means further comprises a pair of load beams extending between said cabinet side walls individually adjacent an associated one of said pivot shafts, the opposite ends of said rails being secured to an associated one of said load beams, the opposite ends of said load beams being removably secured by fastener means to said bracket plates.

40. The refuse compactor set forth in claim 39 wherein each of said bracket plates is provided with front and rear notch means for removably receiving the associated ends of said pivot shafts, said front notch means being disposed closest to the front of said cabinet for removably receiving the front one of said pivot shafts therein, said front notch means comprising a notch having a downwardly facing opening communicating with a vertically extending leg and a horizontal leg leading from the upper end of said vertical leg forwardly toward the front of said cabinet, said rear notch means comprising a vertical leg open at its lower end to receive the rear one of said pivot shafts upwardly therein, said rear notch means having detent means associated therewith for capturing the associated end of said rear pivot shaft in said second notch means and releasable to permit downward extraction of the associated end of said rear pivot shaft from said second notch means, whereby said compacting mechanism is removably mounted by insertion of the ends of said pivot shafts in said bracket plate notch means.

41. The refuse compactor set forth in claim 39 wherein said rear one of said load beams is vertically dimensioned so as to provide a stop engagable by said linkage during the last increment of upward retractile motion thereof to thereby cause the linkage to pivot upwardly and forwardly during such last upward retractile motion thereof, said linkage carrying at its forward end limit switch means engagable with the undersurface of the top wall of the cabinet after said linkage has engaged said rear load beam.

42. In a refuse compactor of the type having a cabinet, a trash basket drawer having an open upper end and a bottom wall, said drawer being removably received via an access opening in the front of the cabinet and horizontally movable between a fully inserted trash compacting position within the cabinet and movable outwardly therefrom to trash loading and unloading positions, and a refuse compacting mechanism mounted in the upper interior region of the cabinet and having a platen connected to said mechanism and movable between a retracted position above the drawer and extended position disposed within the drawer when the latter is in its compacting position, the improvement wherein said platen comprises a bottom wall formed from a one piece sheet metal member and having a pair of side walls and a pair of end walls connected to said bottom wall, said bottom wall having a part-cylindrical shape so as to be curved upwardly about an axis of curvature extending parallel to the longitudinal dimension of said bottom wall, the bottom upwardly curved face of said bottom wall being exposed to the interior of said drawer for directly contacting and compacting trash received therein.

43. The refuse compactor as set forth in claim 42 wherein said platen includes four struts each secured at a lower end thereof and to an associated one of the four corners of said platen and extending upwardly therefrom, said mechanism including extensible linkage means pivotally connected to the upper ends of each of said struts.

44. The refuse compactor as set forth in claim 43 wherein said platen has an open-ended four-sided sheath comprising upward integral extensions of said side and end walls of said platen and extending thereabove to help prevent refuse from collecting on the upper surface of said platen bottom wall.

45. In a refuse compactor comprising a framework, a receptacle removably received in said framework adjacent one end of said framework and having an open end facing the end of the framework opposite said one end, a compacting mechanism mounted in said framework adjacent said opposite end thereof including a presser platen movable into and out of the open end of said receptacle between extended and retracted positions thereof, said mechanism comprising an extensible toggle linkage means having first connector means operably connected to said framework, second connector means operably connected to said platen and movable therewith, and third connector means intermediate said first and second connector means and comprising first and second spaced pivot means movable relative to one another transversely of the direction of movement of said platen to extend and retract said linkage means, and a motor mounted on and carried by said toggle linkage means for bodily movement therewith, said toggle linkage means including force transmitting means operably coupling said motor with said toggle linkage means for causing said relative movement of said spaced pivot means to thereby move said platen between said extended and retracted positions thereof, said force transmitting means comprising a threaded shaft and nut rotatable relative to one another by said motor and mounted for bodily movement with said toggle linkage means, a trunnion block in which said shaft is journalled for rotation, a flat motor mounting plate secured at one end to said block and extending therebeyond, said motor being mounted to said plate in cantilever fashion with the motor armature shaft being oriented parallel to said shaft, and a force multiplying drive train coupling said motor armature shaft to the said threaded shaft, said drive train including a drive pinion on said motor armature shaft, a larger driven pinion meshing with motor drive pinion, said larger pinion being journalled on a stud shaft and keyed thereto for rotation therewith, the improvement wherein said stub shaft is journalled in a one-piece plastic part which includes said driven pinion and a pair of bushings, one of said bushings having a sleeve portion protruding through and journalled in a bearing bore hole in said plate and the other of said bushings having a sleeve portion extending toward said motor, said stud shaft protruding at its ends beyond the ends of said bushing sleeves, a one-piece bracket cup secured to said plate between said motor and said plate and abutting said sleeve of said other bushing and having said stud shaft journalled therein, a drive sprocket secured on the end of said stud shaft on the side of said plate remote from said motor, and a larger driven sprocket secured to a protruding end of said threaded shaft and a chain trained over said sprockets.

46. The improvement set forth in claim 45 wherein said bracket cup has a flexible tang protruding therefrom toward said motor and yieldably engaging a groove in the end of said stud shaft protruding through said cup toward said motor for restraining axial movement of said stud shaft relative to said plate.

47. The improvement set forth in claim 45 wherein said plate has a plurality of keyhole shaped slots spaced at intervals around said bearing bore hole and said bracket cup has a plurality of locking tabs one associated with each of said keyhole slots in said plate and insertable therethrough and engaging said remote side of said plate by slight rotation of said cup bracket relative to said plate, said bracket cup also having a locking pin yieldably biased into an associated locking hole in said plate when registered therewith by said rotation of said cup.

48. The improvement set forth in claim 45 wherein said plate has an extruded portion providing an annular boss surrounding said bearing bore hole in said plate, said bearing bore hole having a bearing wall formed by the wall of the plate hole as well as the wall of said boss.

49. The improvement set forth in claim 45 wherein said bracket cup has a part cylindrical major wall encircling most of said driven pinion and a part cylindrical minor wall integral with said major wall and encircling most of said drive pinion, said cup having an end wall integrally joined to said major and minor side walls and having an opening therethrough for receiving said drive pinion therethrough.

50. In a refuse compactor of the type having a cabinet, a trash basket drawer having an open upper end and a bottom wall, said drawer being removably received via an access opening in the front of the cabinet and horizontally movable between a fully inserted trash compacting position within the cabinet and movable outwardly therefrom to trash loading and unloading positions, and a refuse compacting mechanism mounted in the upper interior region of the cabinet and having a motor drive operably coupled thereto and a platen movable by said mechanism between a retracted position above the drawer and extended position disposed within the drawer when the latter is in its compacting position, the improvement wherein said platen comprises a one piece sheet metal member having a bottom wall and a pair of side walls and a pair of end walls extending upwards from said bottom wall, said bottom wall having reinforcing means formed therein and extending along said bottom wall, said reinforcing means including the bottom face of said bottom wall exposed to the interior of said drawer for directly contacting and compacting trash received therein, said bottom wall face having a smooth upwardly curved surface to present a concave contour to the trash or refuse being compacted by said platen.

51. In a refuse compactor comprising a framework, a receptacle removably received in said framework adjacent one end of said framework and having an open end facing the end of the framework opposite said one end, a compacting mechanism mounted in said framework adjacent said opposite end thereof including a presser platen movable into and out of the open end of said receptacle between extended and retracted positions thereof, said mechanism comprising a motor and force transmitting means operably coupling said motor with said mechanism for causing said relative movement of said platen between said extended and retracted positions thereof, said force transmitting means comprising a threaded shaft and nut rotatable relative to one another by said motor, said motor being mounted on and at one side of a support plate with the motor armature shaft oriented parallel to said shaft, and a force multiplying drive train coupling said motor armature shaft to the said threaded shaft, said drive train including a drive pinion on said motor armature shaft, a larger driven pinion meshing with motor drive pinion, said larger pinion being mounted on a stub shaft journalled in said support plate, said stud shaft protruding at its opposite ends beyond the opposite sides of said plate, a drive sprocket secured on the end of said stud shaft on the side of said plate remote from said motor, and a larger driven sprocket secured to a protruding end of said threaded shaft and a chain trained over said sprockets, said driven sprocket and said motor drive pinion being disposed on opposite sides of said stub shaft.

* * * * *